US005655949A

United States Patent [19]

Clover

[11] Patent Number: 5,655,949

[45] Date of Patent: *Aug. 12, 1997

[54] METHOD OF POLISHING WAXERS USING A VERTICALLY STACKED PLANARIZATION MACHINE

[76] Inventor: Richmond B. Clover, 1199 W. Vanderbilt Ct., Sunnyvale, Calif. 94087

[ * ] Notice: The term of this patent shall not extend beyond the expiration date of Pat. No. 5,554,065.

[21] Appl. No.: 612,819

[22] Filed: Mar. 11, 1996

Related U.S. Application Data

[63] Continuation of Ser. No. 473,424, Jun. 7, 1995, Pat. No. 5,554,065.

[51] Int. Cl.[6] ..... B24B 1/00

[52] U.S. Cl. ..... 451/41; 451/283

[58] Field of Search ..... 451/41, 36, 283, 451/285, 287, 288, 289, 56, 271, 270, 443

[56] References Cited

U.S. PATENT DOCUMENTS

| | | | |
|---|---|---|---|
| 4,481,741 | 11/1984 | Bpouladon et al. | 451/285 |
| 5,216,843 | 6/1993 | Brievogel et al. | 451/285 |
| 5,232,875 | 8/1993 | Tuttle et al. | 451/270 |
| 5,240,557 | 8/1993 | Dyer et al. | 156/654 |
| 5,329,732 | 7/1994 | Karlsrud et al. | 451/289 |
| 5,435,772 | 7/1995 | Yu | 451/287 |

*Primary Examiner*—James G. Smith
*Assistant Examiner*—Dona C. Edwards
*Attorney, Agent, or Firm*—Haverstock & Associates

[57] ABSTRACT

A vertically stacked planarization machine includes two or more vertically stacked individual platens on which wafers are polished. The wafers are held by wafer holders which may rotate the wafers. The individual platens are also orbited in order to polish the wafers. The platens may have a top and bottom polishing pad for polishing multiple wafers. A single wafer holder, using hydraulic or pneumatic means, between two platens will hold and exert pressure on both a downward wafer and an upward wafer. The pressure exerted onto the top and bottom wafers by the dual wafer holder is designed to be equal to prevent any bowing of the platen. The platens are supported by three vertical members positioned at 120 degree intervals around the circumference of the platens to form a platen stack. Transport elevators are used to carry the wafers to and from the wafer holders and the platens. A polishing pad conditioner is also transported to the polishing pads within the stack periodically by use of a transport elevator in order to unglaze the polishing pad. In order to increase capacity, a single polishing machine may include more than one vertical stack of platens. A cam contains the stack and will drive the stack, during polishing, into an orbital motion. Each of the components of the stack is detachable for servicing and repair. A stack, in its entirety, may also be removed from the polishing machine for servicing.

26 Claims, 22 Drawing Sheets

METHOD OF POLISHING WAXERS USING A VERTICALLY STACKED PLANARIZATION MACHINE

This is a continuation of application Ser. No. 08/473,424 filed on Jun. 7, 1995 now U.S. Pat. No. 5,554,065.

FIELD OF THE INVENTION

The present invention relates to the field of integrated circuit manufacturing technology. More particularly, the present invention relates to the field of machines and processes for planarizing surfaces of wafer-type substrates, such as those of semiconductor wafers.

BACKGROUND OF THE INVENTION

The planarity of wafer surfaces is very important when manufacturing integrated circuits. Photolithographic processes are typically pushed close to the limit of resolution in order to create maximum circuit density. The minimum critical dimensions which are typically required on a circuit are very small. Because these circuits are produced using photolithography it is essential that the wafer surface be highly planar in order that the electromagnetic radiation used to create a mask may be accurately focused at a single level, resulting in precise imaging over the entire surface of the wafer. If the wafer surface is not sufficiently planar the resulting mask will be poorly defined which may cause the circuit to malfunction.

Chemical mechanical planarization processes are used to achieve the degree of planarity required to produce ultra high density integrated circuits. Chemical mechanical planarization (CMP) processes involve planarizing a wafer by pressing it against a moving polishing surface that is wetted with a chemically reactive, abrasive slurry. The slurry is usually either basic or acidic and generally contains alumina or silica particles. The polishing surface is typically a planar pad made of a relatively soft, porous material such as blown polyurethane. The pad is usually mounted on a planar platen.

A conventional rotational CMP apparatus is illustrated in FIG. 1. A semiconductor wafer 112 is held by a wafer carrier 111. A soft, resilient pad 113 is positioned between the wafer carrier 111 and the wafer 112. The wafer 112 is held against the pad 113 by a partial vacuum. The wafer carrier 111 is continuously rotated by a drive motor 114 and is also designed for transverse movement as indicated by the arrow 115. The rotational and transverse movement is intended to reduce variability in material removal rates over the surface of the wafer 112. The apparatus further comprises a rotating platen 116 on which is mounted a polishing pad 117. The platen 116 is relatively large in comparison to the wafer 112, so that during the CMP process, the wafer 112 may be moved across the surface of the polishing pad 117 by the wafer carrier 111. A polishing slurry containing a chemically reactive solution, in which are suspended abrasive particles, is deposited through a supply tube 118 onto the surface of the polishing pad 117.

A top view of a typical polishing table of the prior art is illustrated in FIG. 2. The surface of the polishing table 1 is precision machined to be quite flat and may have a polishing pad affixed to it. The surface of the table rotates the polishing pad past one or more wafers 3 to be polished. The wafer is held by a wafer holder, as illustrated in FIG. 1, which exerts vertical pressure on the wafer against the polishing pad. The wafer holder may also rotate or orbit the wafer on the table during wafer polishing.

Alternatively, the table 1 may be stationary and serve as a supporting surface for individual polishing platens 2 each having their own individual polishing pad. As taught by U.S. Pat. No. 5,232,875, issued to Tuttle et al., each platen may have its own mechanism for rotating or orbiting the platen 2. A wafer holder will bring a wafer in contact with the platen 2 and an internal or external mechanism to the wafer holder may be used to also rotate the wafer during the polishing operation. In this polishing table, having multiple individual platens, each platen must be precision machined. While precision machining each individual platen is difficult, it is more difficult to precision machine a large moving table holding a polishing pad many times the area of an individual platen.

The wafers 3 are typically stored and transported in wafer cassettes which hold multiple wafers. The wafers 3 or wafer holders are transported between the wafer cassettes and the polishing table 1 using the wafer transport arm 4. The wafer transport arm 4 will transport the wafers 3 between the polishing table and the stations 5, which may be wafer cassette stations or wafer monitoring stations.

The polishing characteristics of the polishing pad will change over time as multiple wafers 3 are polished by the polishing pad. This glazing or changing of the polishing characteristics will effect the planarization of the surface of the wafers 3 if the pads are not periodically conditioned and unglazed. The pad conditioner 6 is used to periodically unglaze the surface of the polishing pad. The pad conditioner 6 has a range of motion which allows it to come in contact with the individual pads and conduct the periodic unglazing and then to move back to its rest position, out of the way of the table, during the polishing of the wafers.

As illustrated in FIG. 2, the table 1 may be used to simultaneously polish multiple wafers on its horizontal surface. Wafers arranged on the horizontal surface may be in a circular configuration, as shown, or they may be in a regular two-dimensional array such as 2×1, 2×2 or 3×2. The distribution of polishing locations on the table 1 in the horizontal xy dimension requires a complex combination of table motion and/or pick and place robotic mechanisms so that the transport arm 4 is able to transport the wafers 3 from the start to finish of the polishing operations and the polishing pad 6 is able to perform the pad conditioner operations and then to retreat to its rest position.

U.S. Pat. No. 5,232,875 to Tuttle et al. teaches that the pressure between the surface of the wafer to be polished and the moving polishing pad may be generated by either the force of gravity acting on the wafer and the wafer carrier or by mechanical force applied normal to the wafer surface. Tuttle et al. also teaches that the slurry may be injected through the polishing pad onto its surface. The planar platens taught by Tuttle et al. are moved in a plane parallel to the pad surface with either an orbital, fixed-direction vibratory, or random-direction vibratory motion.

The horizontal polishing tables as taught by the prior art take up a large amount of valuable floor space within the manufacturing facility. What is needed is a wafer polishing apparatus which achieves more wafer throughput within the same amount of floor space thereby minimizing the floor space required within the manufacturing facility per polished wafer. What is further needed is a wafer polishing apparatus which does not require the complex robotic systems, capable of movement within the xy direction, as necessary for polishing tables of the prior art to transport wafers to and from a horizontal polishing table and also to polish the platens on a horizontal polishing table.

SUMMARY OF THE INVENTION

A vertically stacked planarization machine includes two or more vertically stacked individual platens on which wafers are polished. The wafers are held by wafer holders which may rotate the wafers. The individual platens are orbited in order to polish the wafers. The platens may have a top and bottom polishing pad for polishing multiple wafers. A single wafer holder, using hydraulic or pneumatic means, between two platens will hold and exert pressure on both a downward wafer and an upward wafer. The pressure exerted onto the top and bottom wafers by the dual wafer holder is designed to be equal to prevent any bowing of the platen. The platens are supported by three vertical members positioned at 120 degree intervals around the circumference of the platens to form a platen stack. Transport elevators are used to carry the wafers to and from the wafer holders and the platens. A polishing pad conditioner is also transported to the polishing pads within the stack periodically by use of a transport elevator in order to unglaze the polishing pad. In order to increase capacity, a single polishing machine may include more than one vertical stack of platens. A cam contains the stack and will drive the stack, during polishing, into an orbital motion. Each of the components of the stack is detachable for servicing and repair. A stack, in its entirety, may also be removed from the polishing machine for servicing.

DETAILED DESCRIPTION OF THE PREFERRED EMBODIMENT

Figure 1:
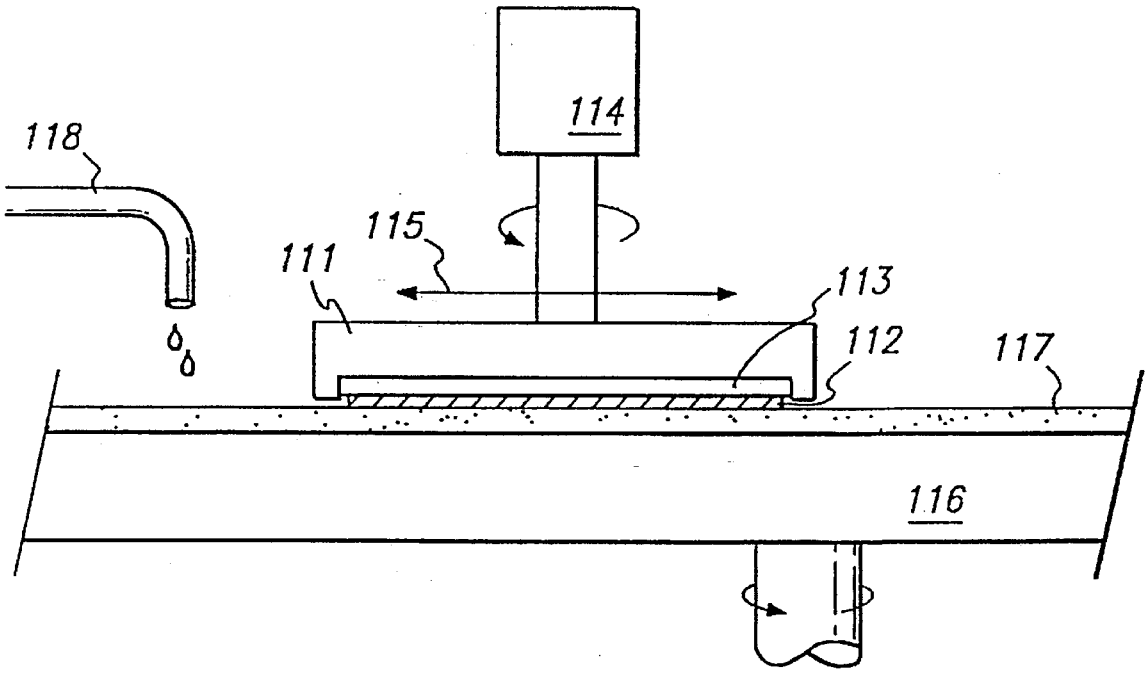
FIGURE 1 (PRIOR ART)
FIG. 1 illustrates a conventional rotational chemical mechanical planarization apparatus of the prior art.
Figure 2:
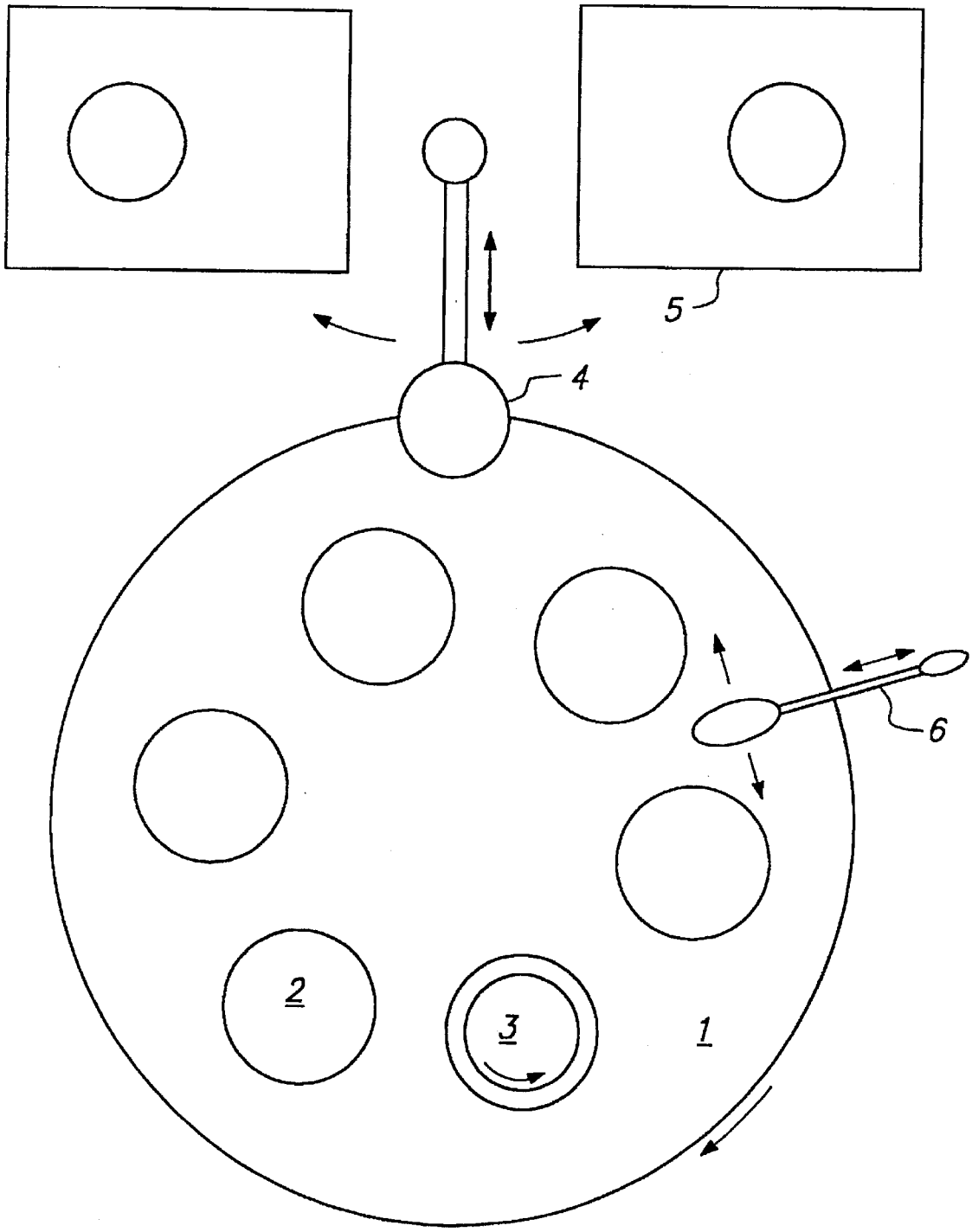
FIGURE 2 (PRIOR ART)
FIG. 2 illustrates a top view of a polishing table of the prior art.
Figure 3:
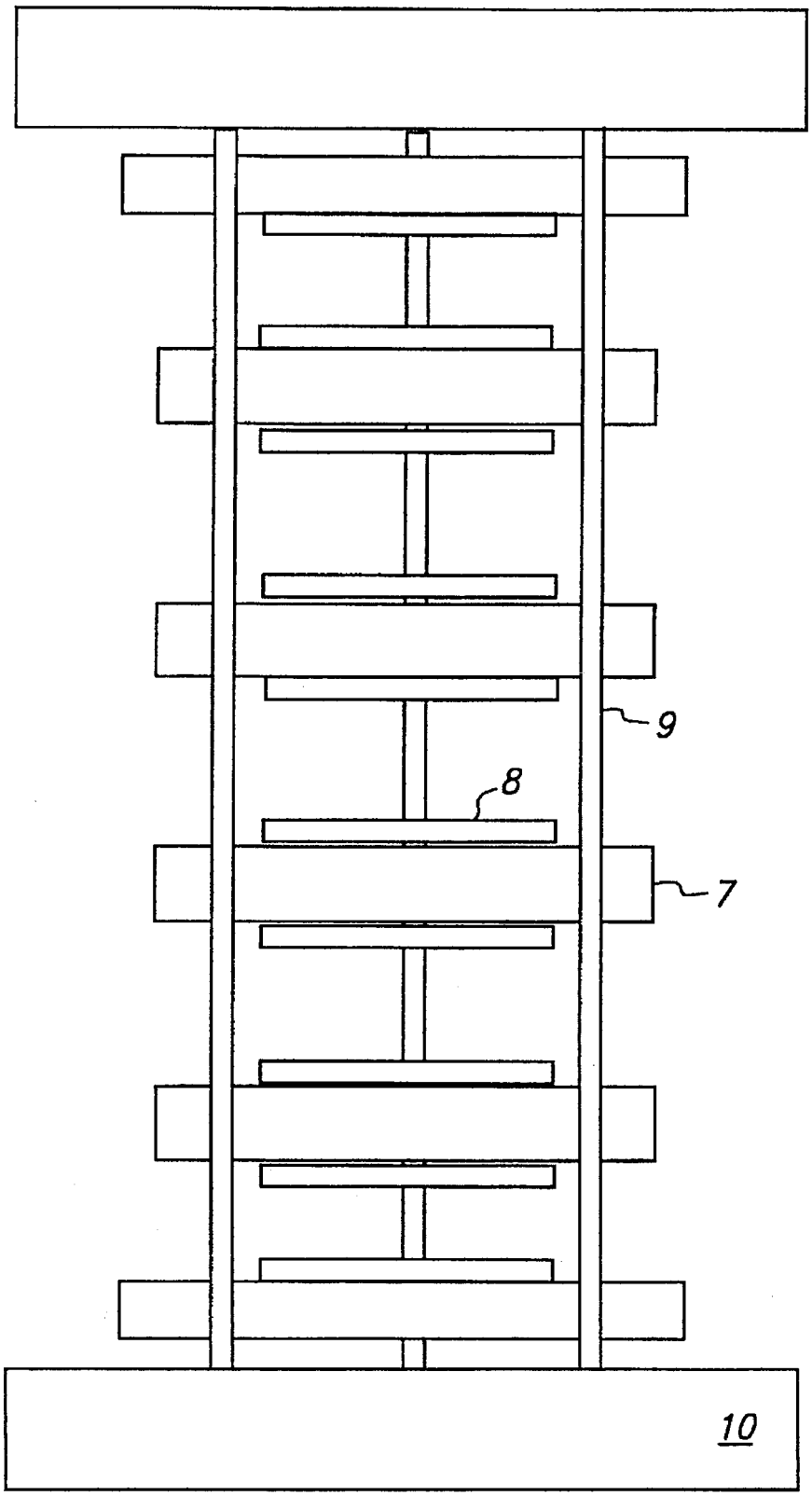
FIG. 3 illustrates a planarization machine according to the present invention including vertically stacked platens.

The planarization machine of the present invention stacks platens 7 in the vertical (z) direction as illustrated in FIG. 3. Polishing pads 8 are affixed to the platens on one or both sides of the platens for polishing multiple wafers simultaneously. The platens 7 are attached to vertical support members 9, such that the vertical supports 9 and platens 7 are one structure that will be driven to orbit for polishing wafers in wafer holders inserted between the vertical supports 9 and the platens 7. The orbiting structure is in turn supported by a stack frame including the top and bottom end plates 10.

Figure 4:
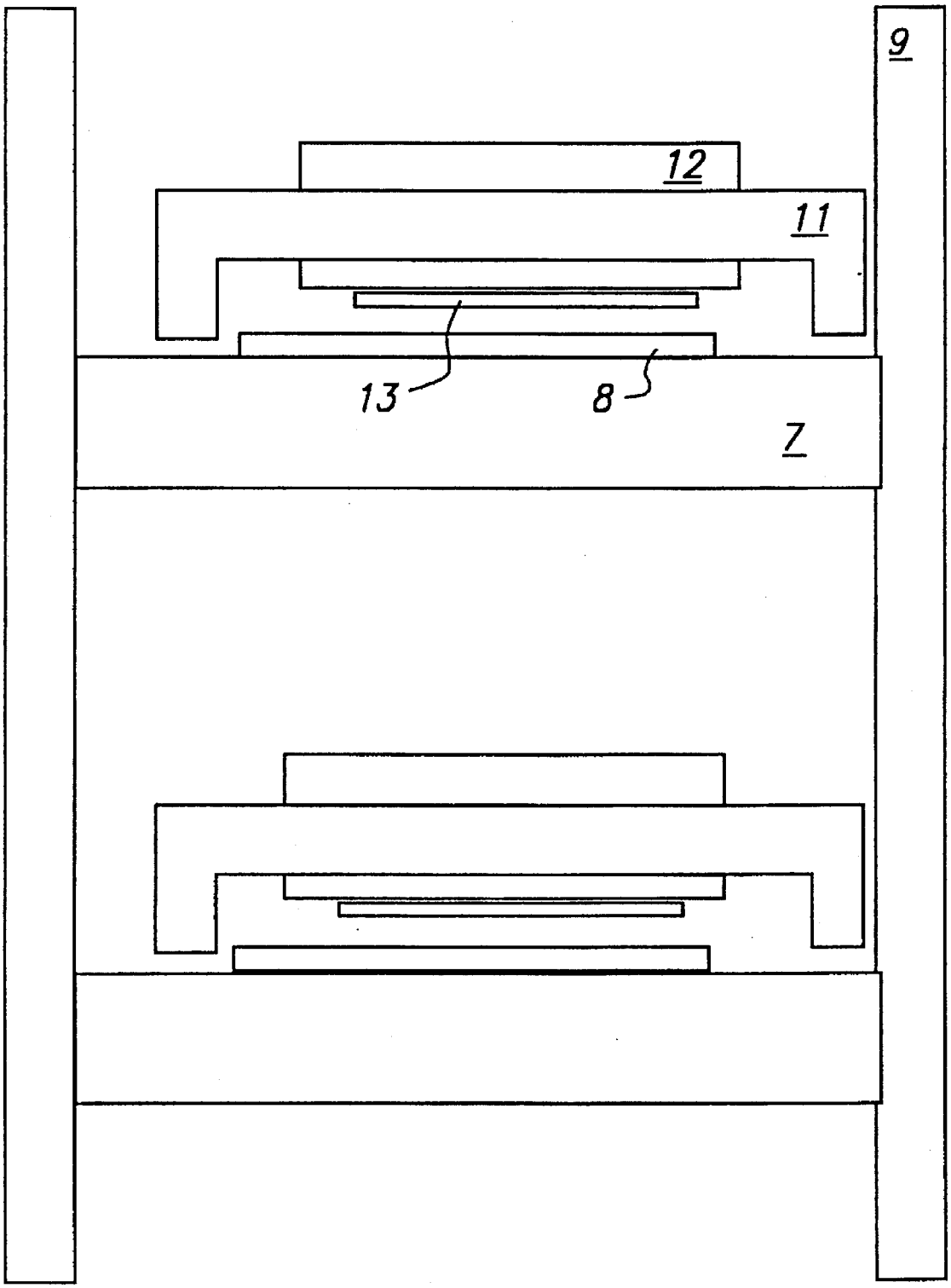
FIG. 4 illustrates a vertical stack including two platens having polishing pads on only one side of the platen.

A vertical stack showing two platens with polishing pads 8 on only one side of the platens 7 is illustrated in FIG. 4. The wafers 13 are affixed to wafer holders 12 such that pressure on the wafers pushing the wafer 13 against the polishing pad 8 may come from the weight of the wafer holder 12, plus pressure applied in the z direction to the wafer holders by mechanical, hydraulic or pneumatic means. The wafer holder 12 includes a guide 11 for guiding the pressure producing portion of the wafer holder 12. The guide 11 may also serve as a leaky reservoir for collecting slurry which is supplied to the region of polishing between the wafer 13 and the polishing pad 8. The slurry may be injected through the pad itself as described in U.S. Pat. No. 5,232,875, or supplied through other conventional means which are well known in the art. The guide 11 must be of a size large enough that it will not contact the orbiting polishing pad 8.

Figure 5:
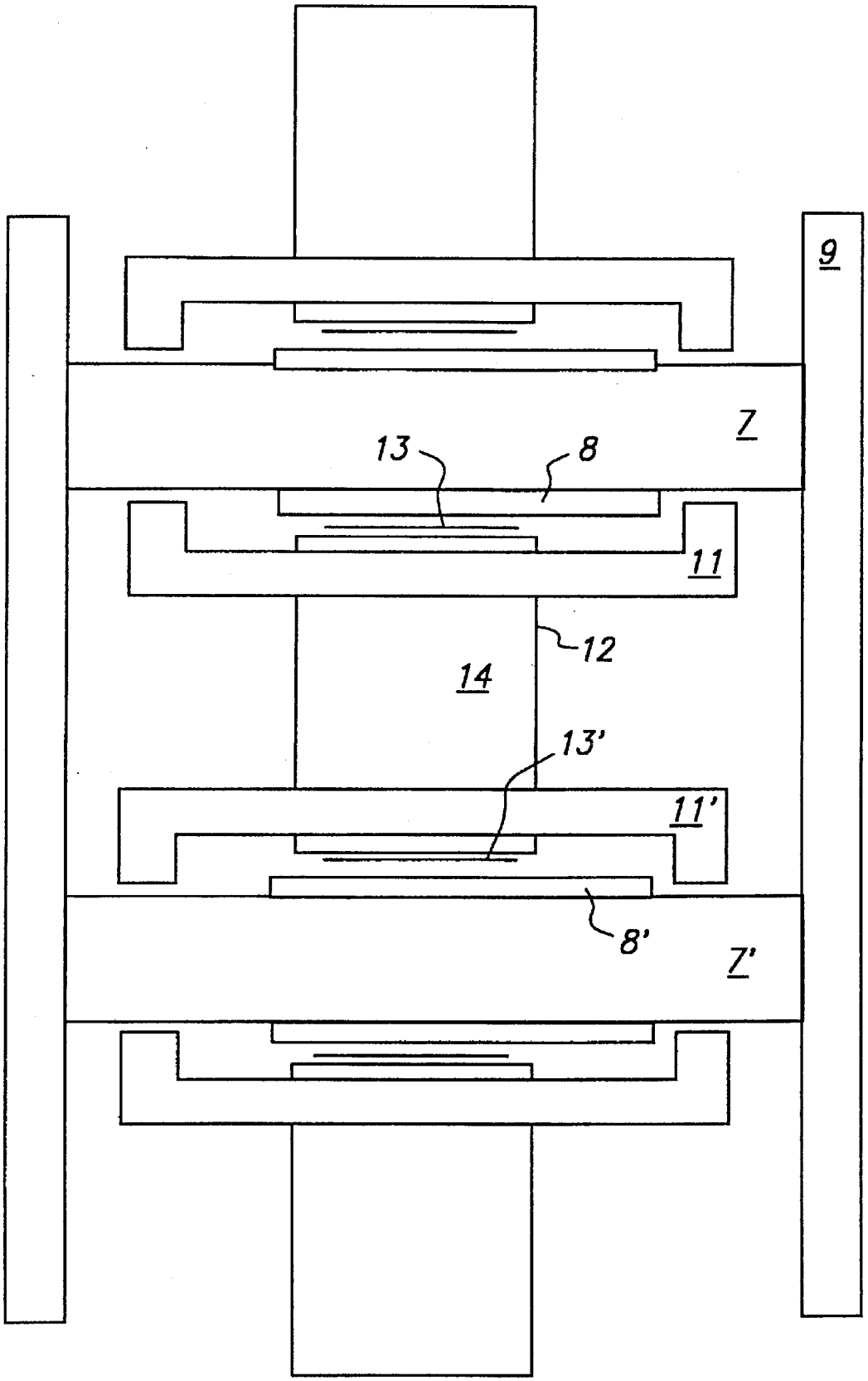
FIG. 5 illustrates a vertical stack including two platens having polishing pads on both sides of the platens.

FIG. 5 shows the platens 7 with pads 8 on both the top side and the bottom side. The wafer holders 12 are designed to hold a top wafer 13 and a bottom wafer 13', one on each end, so that the top wafer 13 is pressed against the top polishing pad 8 and the bottom wafer 13 is pressed against the bottom polishing pad 8'. The center portion of the wafer holder 14 must be capable of delivering pressure to both wafers in opposite directions to bring each of the wafers 13 and 13' in contact with their respective polishing pads 8 and 8'. The center portion of the wafer holder 14 includes an internal structure that allows mechanical, hydraulic or pneumatic forces to be applied to both wafers. The internal structure is designed so that the pressure on all wafers 13 in the stack will be identical during polishing. The forces applied by the two wafers in contact with the top and bottom of each individual platen 7 will therefore cancel out, so that there is no bowing of the platen 7 due to the wafers 13 pressing against it.

The wafers 13 are brought to the wafer holders 12 by a stack elevator which moves in the z direction between a wafer cassette and the individual platens of the stack, as will be illustrated and described in detail below. The wafer holders 12 are designed so that they come to a position outside of the stack when a polished wafer is being taken back to the wafer cassette and a wafer to be polished is being brought to the wafer holder. The wafer holders 12 may be moved in and out of the stack by either a circular rotated motion, a linear motion or by a combination of a linear motion and a circular motion. The only constraints on the range of motion of the wafer holders 12 is that the wafer holders 12 must avoid the platen stack support members 9. The wafer holders 12 will also rotate to the position outside of the stack when the polishing pads 8 are being unglazed.

Figure 6:
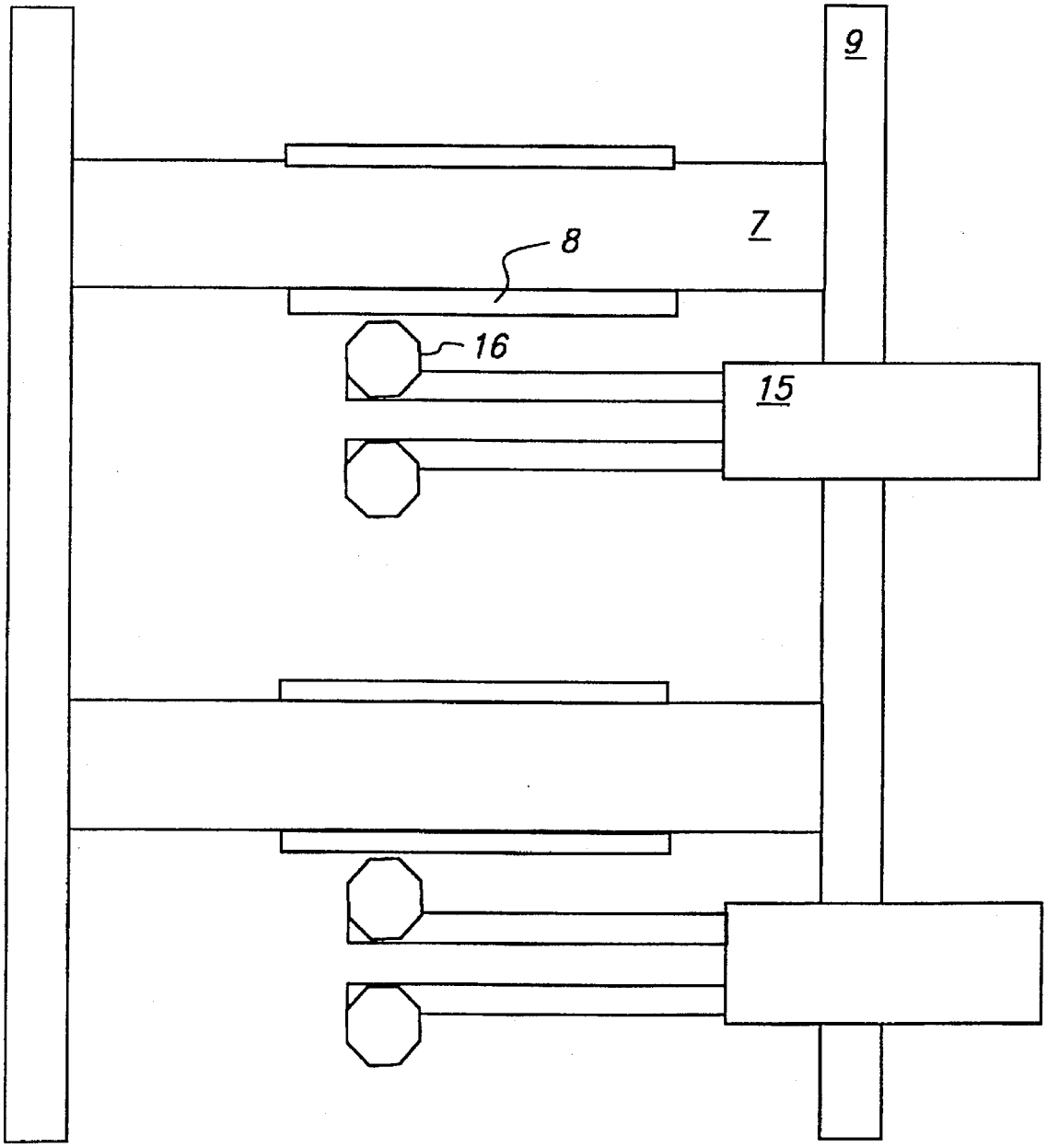
FIG. 6 illustrates the use of pad conditioner end effectors for unglazing the polishing pads.

FIG. 6 shows how pad conditioner end effectors 16 are brought into contact with the polishing pads 8, held by the platens 7. A pad conditioner arm 15 is used to transport the pad conditioner end effectors 16 to the polishing pads 8. The pad conditioner arm 15 is inserted and removed between the platen stack vertical support members 9. The pad conditioner arm 15 may also be moved into and out of the platen stack using either a circular rotated motion, a linear motion or a combination of a linear motion and a circular motion as long as the platen stack support members 9 are avoided. A means for moving the pad conditioners 16 in the z-direction to the polishing pads 8, with the pad conditioners 16 either inside or outside of the stack, is accomplished using an elevator mechanism, which will be described in detail below.

Figure 7:
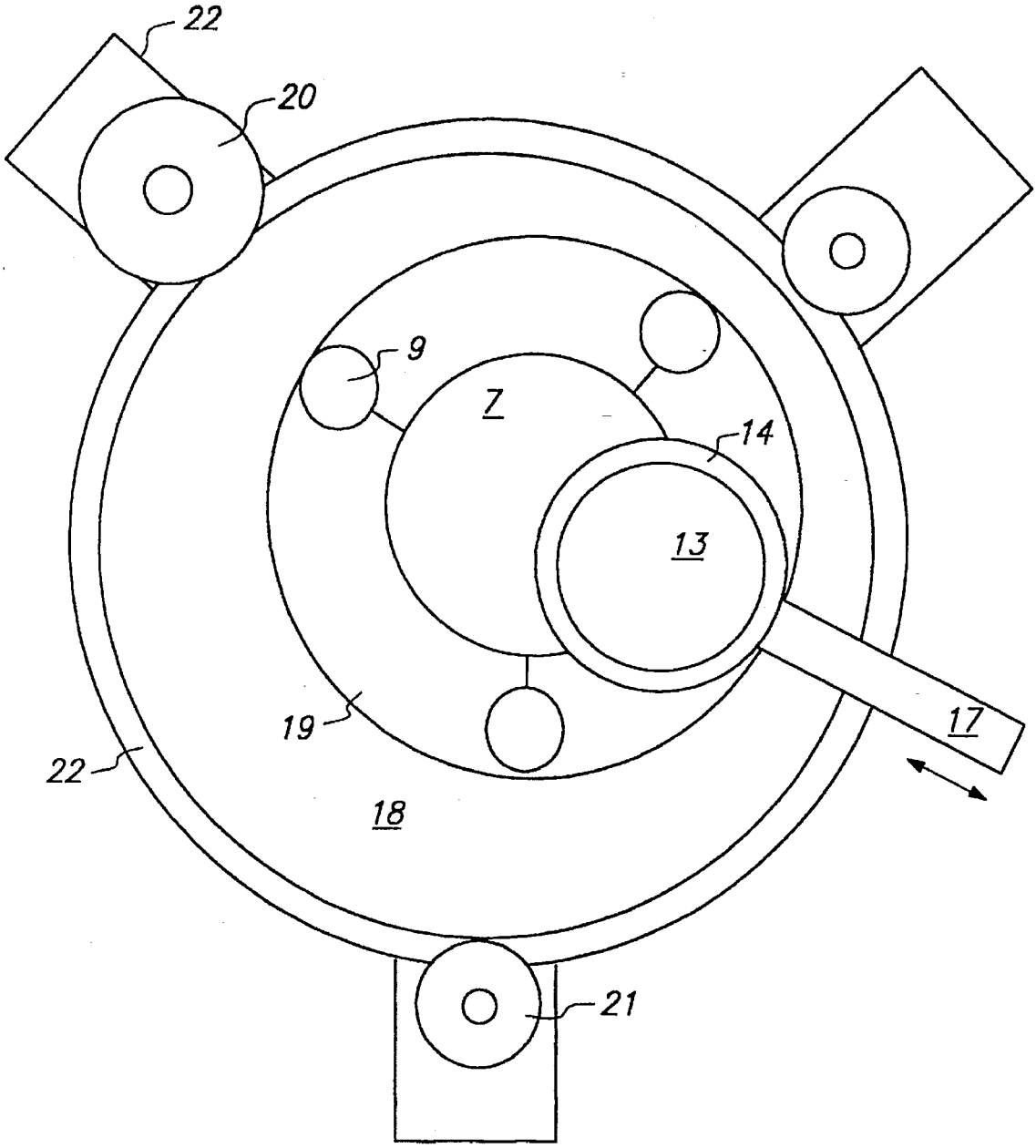
FIG. 7 illustrates a cross-section of the polishing stack of the present invention, including a wafer holder and cam. The cam produces a locus of orbital motion of the stack.

FIG. 7 shows a cross-section of the polishing stack including the platen 7, the vertical support members 9 and a means 17 for inserting and removing the wafer holder 14 carrying a wafer 13, from inside the stack and the region of the platen 7. Also shown in FIG. 7 is a cam 18 with an offset opening 19 which makes contact with the vertical support members 9. When the cam 18 is rotated, the polishing stack will act like a cam follower and orbit with respect to the wafer holders 14 and the stack frame. A mechanical drive element 20, linked to a driving mechanism, is used to rotate the cam 18. The mechanical drive element 20 is coupled to part of the stack frame structure 22. The drive element 20 of the preferred embodiment is a motor. Bearing structures 21 coupled to the stack frame structure are used to hold the cam in position. The vertical support members of the stack frame structure are in approximate radial alignment with the vertical support members 9 of the stack. The stack will therefore orbit with respect to the stack frame. When the cam 18 is brought to rest, the wafers 13, the wafer holders 14 and the pad conditioners 16 are inserted and removed between the vertical supports of the stack and the stack frame.

Figure 8A:
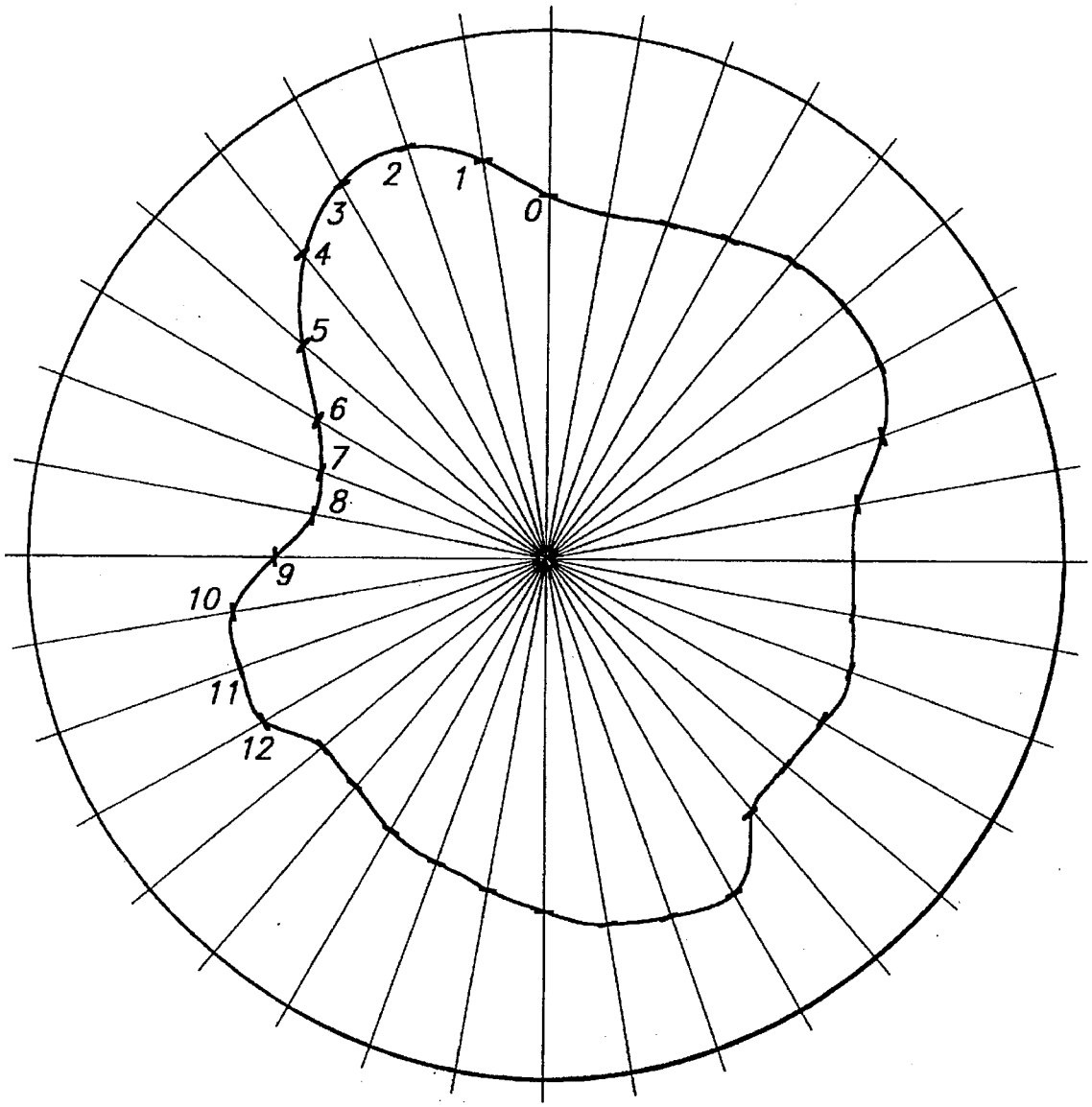
FIG. 8 illustrates the locus of the linear oscillation of the stack as driven by the cam.
Figure 8B:
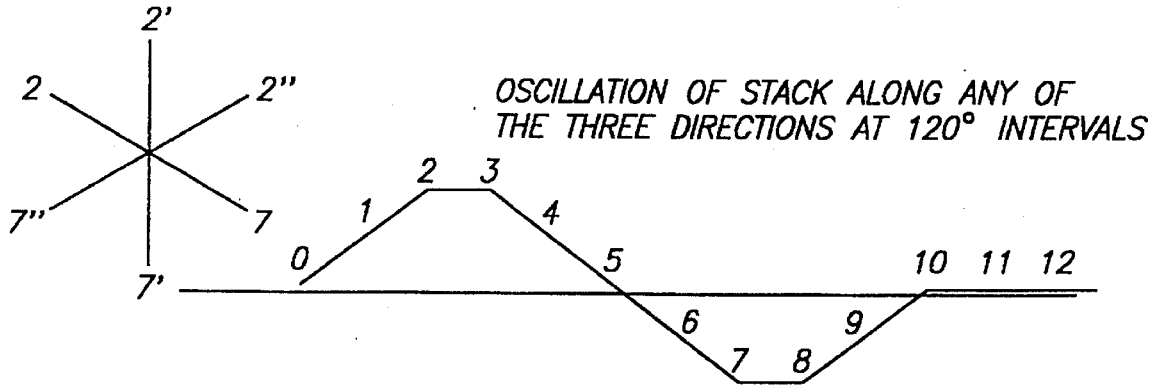
Figure 13:
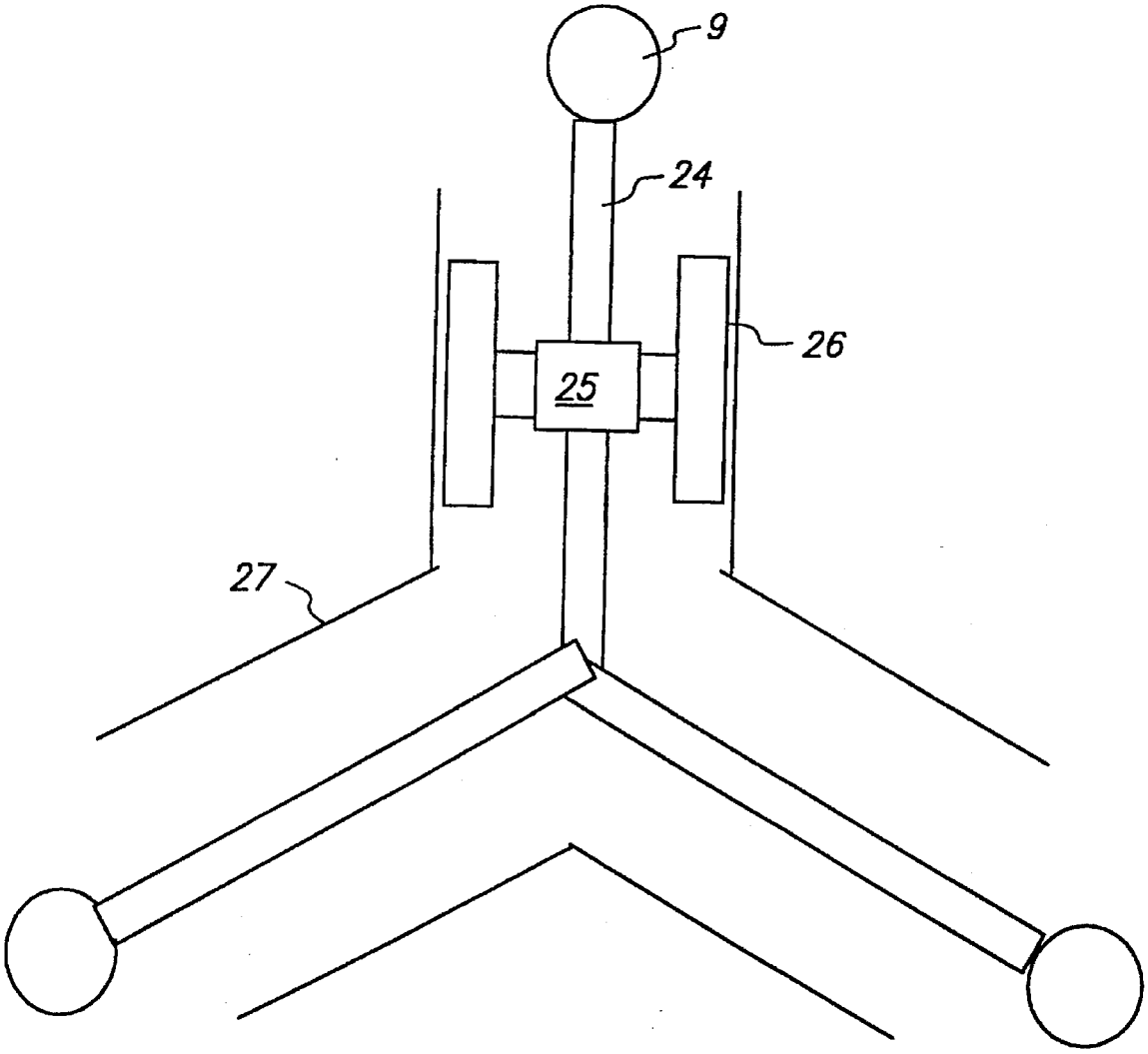
FIG. 13 illustrates a piston-like structure, included within the stack frame end plates for holding the platen stack.

In the preferred embodiment of the present invention the opening of the cam 18 is circular, as illustrated in FIG. 7, causing the platen stack to orbit in a circle determined by the amount of offset of the opening. The stack must be constrained from rotating in its own frame of reference, as shown in FIG. 13 below. The cam opening 18 may be of a shape other than circular if rotational symmetry rules are followed. For example, if there are 3 vertical platen stack supports, they must be radially separated by 120 degrees. The cam opening 18 must be cut so it has trifold symmetry. This means that the same shape cut is repeated every 120 degrees. As the cam 18 rotates, the platen stack will orbit following some locus for the first 120degrees of cam rotation, then it will follow the same locus with a 120 degree displacement for the second 120 degrees of cam rotation, and similarly for the third 120 degrees of cam rotation. For example, as illustrated in FIG. 8, the locus might be a linear oscillation such that in one complete rotation of the cam 18, the stack oscillates along a line at 0 degrees, then along a line at 120 degrees, and finally along a line at 240 degrees, each of the three oscillations being identical except for the radial displacement of one to the next.

Figure 9:
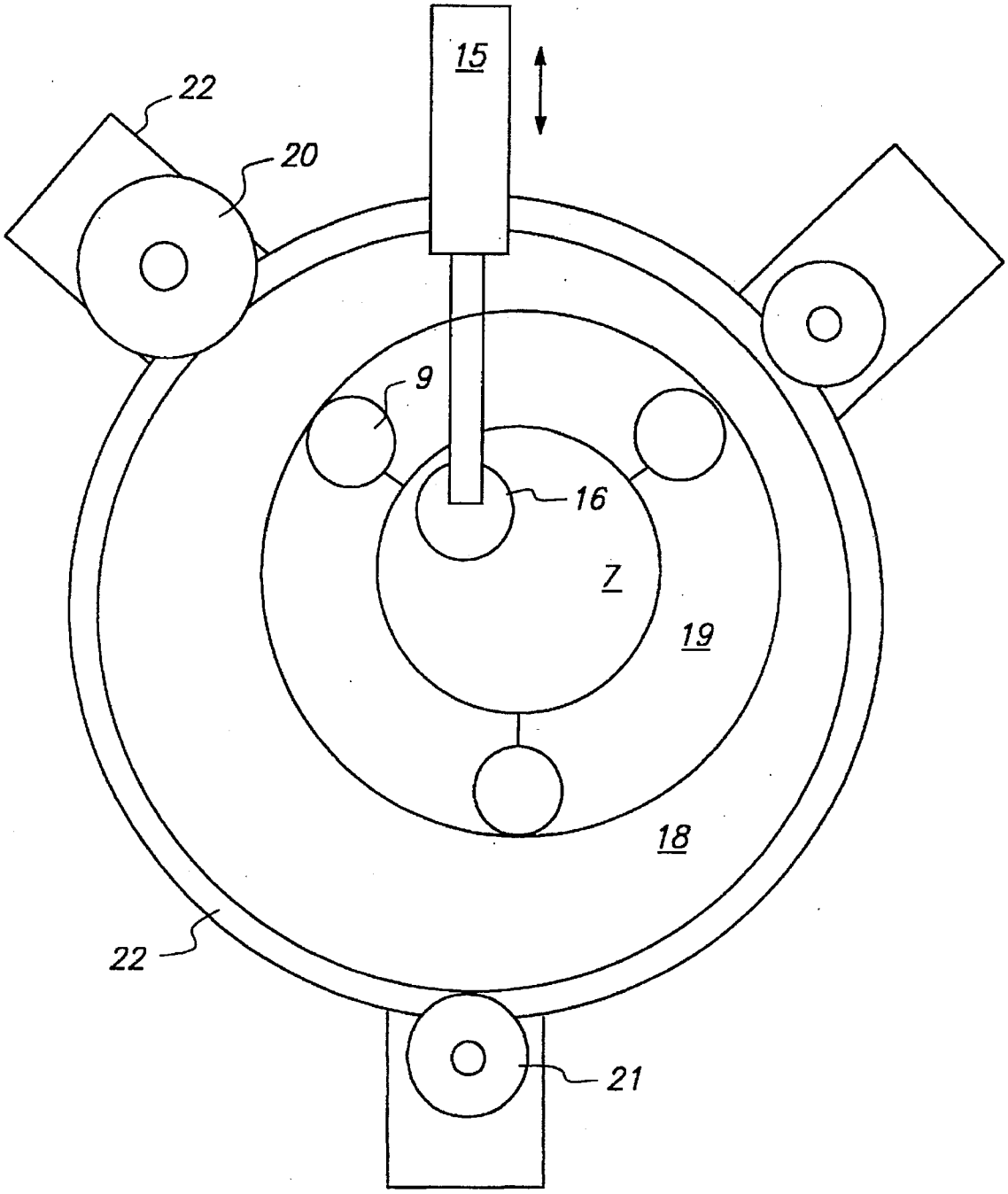
FIG. 9 illustrates a cross-section of the polishing stack of the present invention, including a pad conditioner.

A cross-section of the stack, cam and stack frame structure is illustrated in FIG. 9. A pad conditioner 16 is inserted in a position to condition a polishing pad 8 on the platen 7. The pad conditioner 16 is transported on the pad conditioner arm 15 to the platens 7. Upon removal of the pad conditioner 16, the wafer holder may be inserted into the stack, onto the region of the platen 7.

Figure 10:
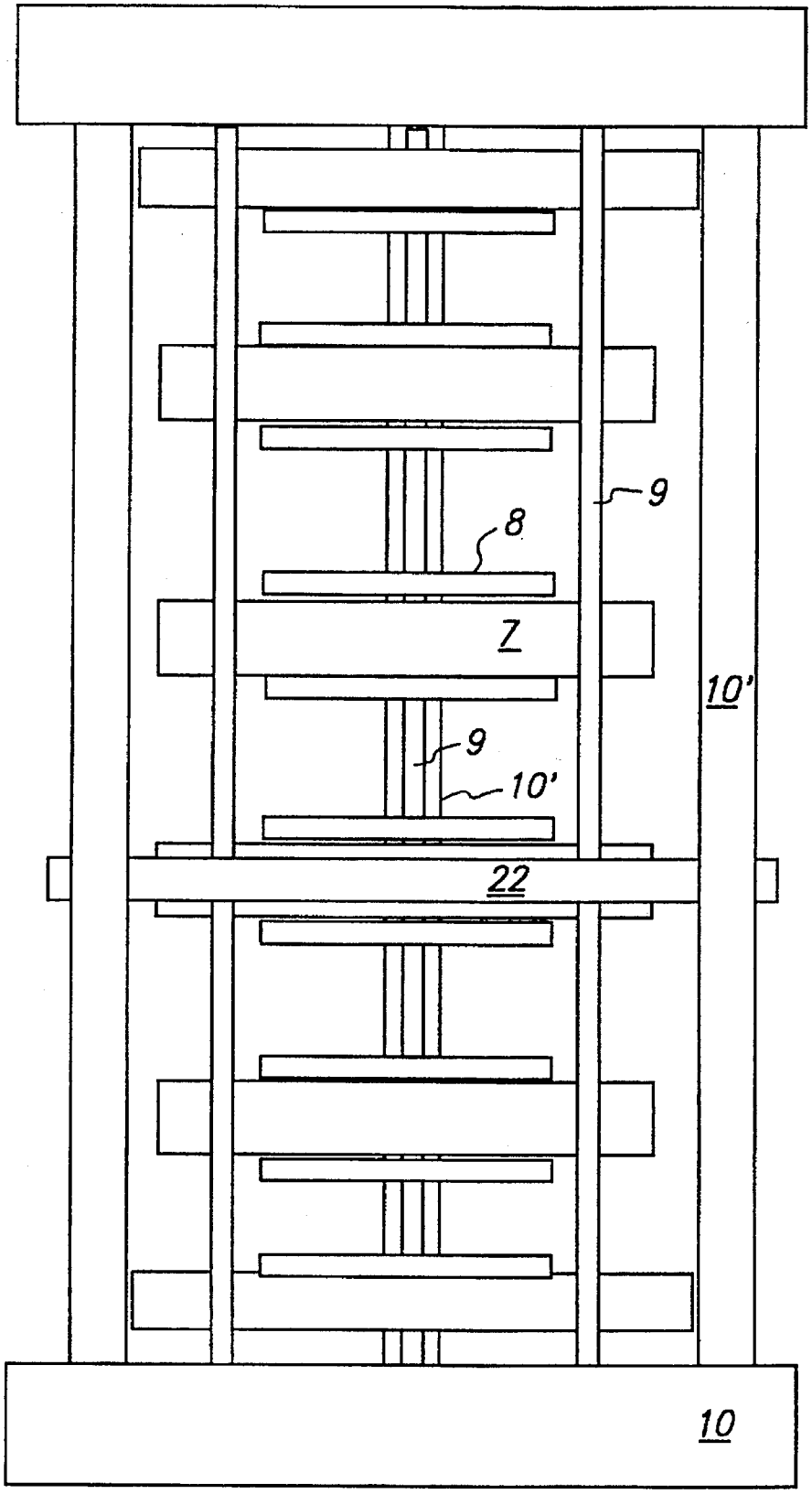
FIG. 10 illustrates a side view of a platen stack including a cam.

A side view of a stack frame including a cam 22 is illustrated in FIG. 10. A platen stack is included inside the stack frame. Openings between the vertical supports 9 and the polishing pads 8 show that there is room for the wafer holders and the pad conditioners to be inserted and removed from the regions between the platens 7. The cam 22 has its center plane at or near the center plane of the platen 7.

Figure 11:
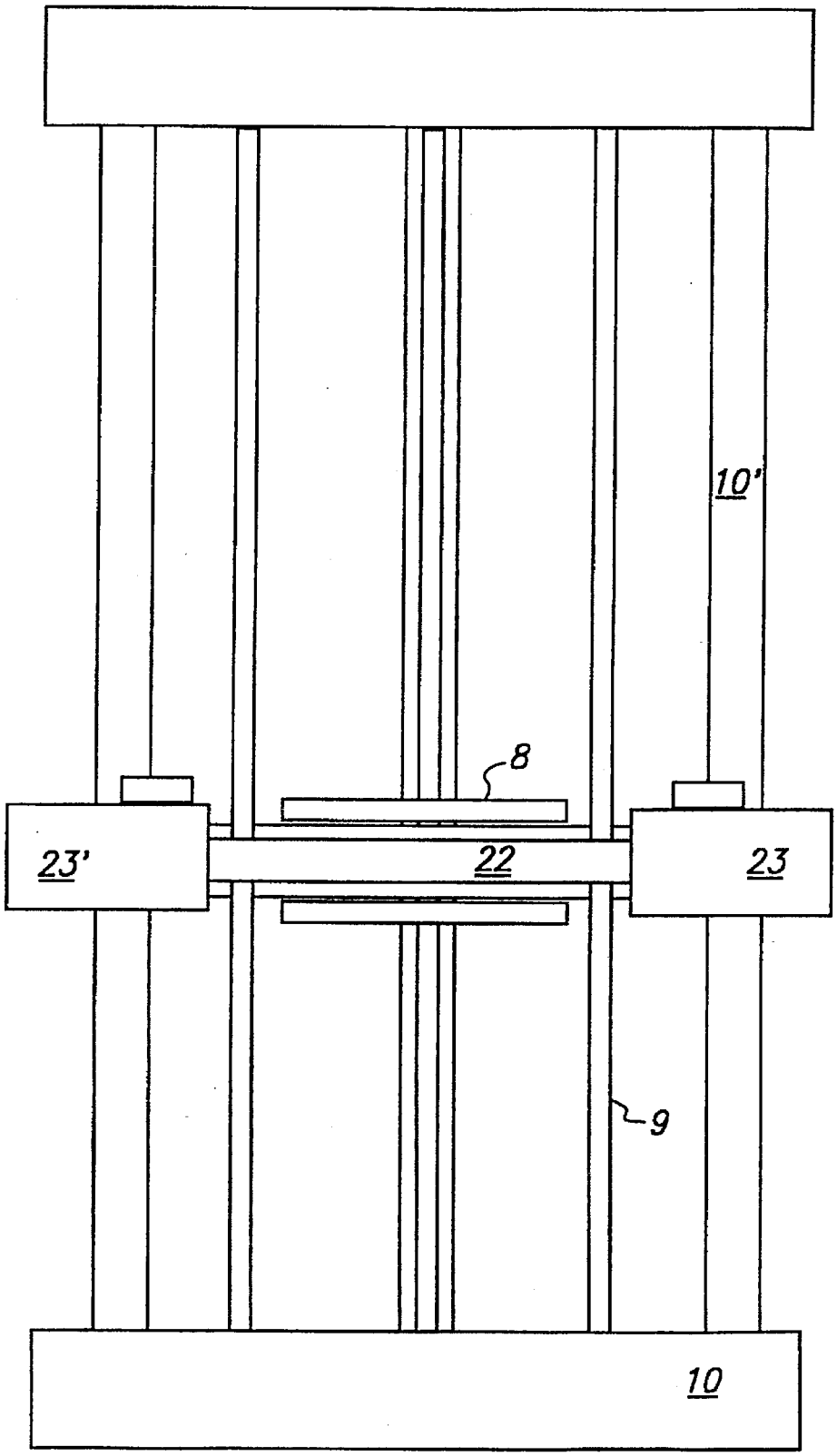
FIG. 11 illustrates a cam support sub-structure of the vertical stack frame according to the present invention.

A cam support sub-structure 23 of the stick frame is illustrated in FIG. 11. The cam support sub-structure 23 supports the cam drive mechanisms and maintains the position of the cam 22 with respect to the platen stack.

Figure 12:
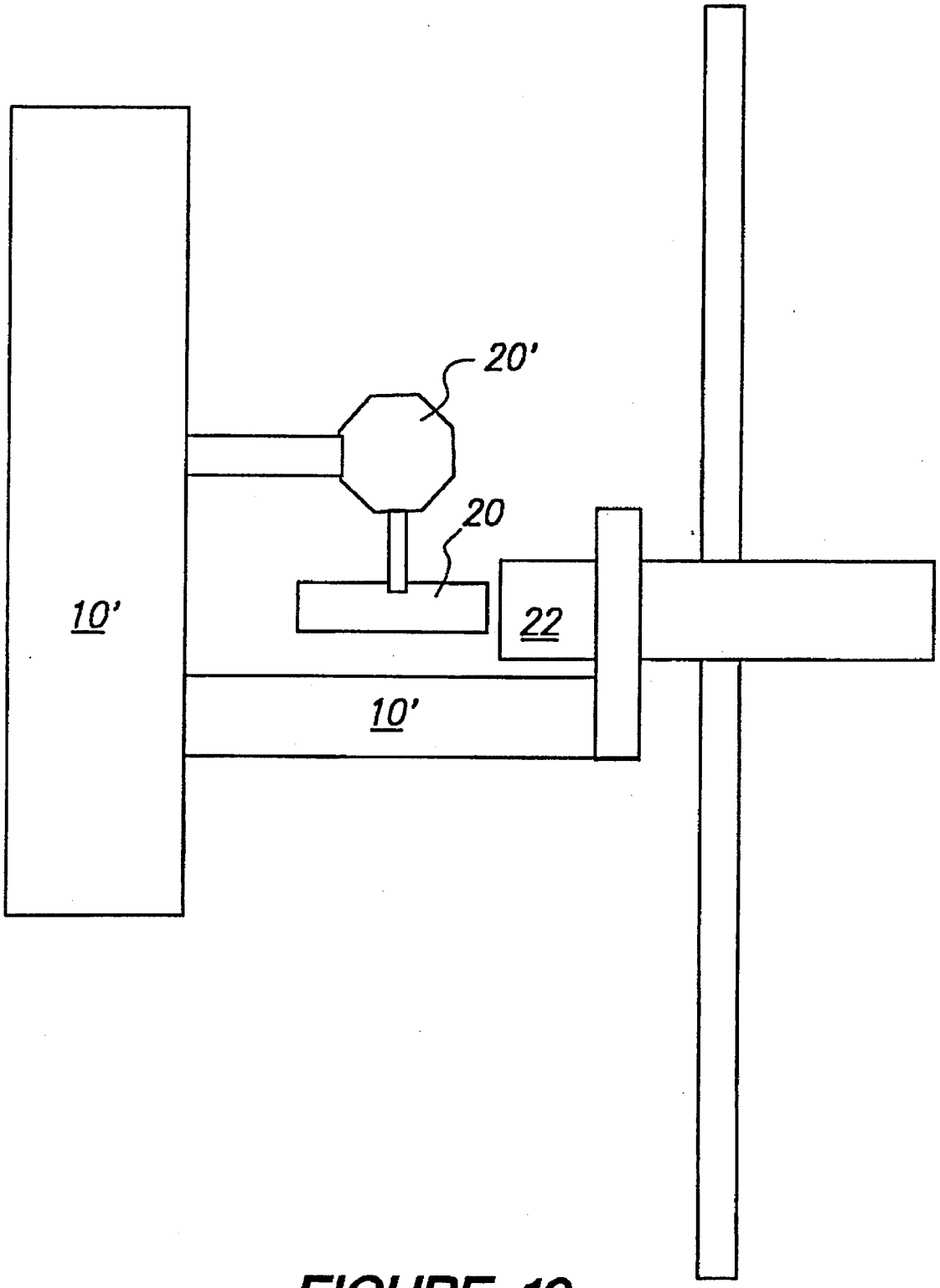
FIG. 12 illustrates the cam drive mechanism, including a cam drive motor, coupled to the stack frame.

FIG. 12 shows the cam drive mechanism 20, including the drive motor 20' coupled to the stack frame 10. The cam 22 contains the platen stack and will make contact with the platen stack using the cam drive mechanism 20. The cam 22 is driven by the drive motor 20' which is coupled to the stack frame 10'. The drive motor 20' controls the immediate torque converter, or worm gear, 20 which is positioned between the drive motor 20' and the cam 22, for rotating the cam 22. When rotating, the cam 22 will cause the platen stack to also orbit relative to the stack frame.

The entire vertical stack frame including the platen stack, cams, cam driver mechanisms and wafer holders is a self-contained subsystem of the polishing machine of the present invention. The vertical stack frame is integrally removable from the polishing machine in order to facilitate servicing of the parts contained within the vertical stack frame. The vertical stack frame and platen stack of the present invention are designed for a relatively easy disassembly and reassembly, including the proper realignment of all of the parts contained within the vertical stack, particularly the alignment of the platens 7 to the wafer holders 14. For example, the platen stack assembly has the overall shape of a cylinder which fits inside the stack frame, also shaped like a cylinder. The first major disassembly step includes pulling the platen stack out of the stack frame. Parts included within the stack frame and parts included within the platen stack may then be separately serviced. Reassembly includes inserting the platen stack back into the stack frame with some alignment operations performed prior to this step, and some alignment operations performed after this step, as necessary to ensure proper alignment of various parts, particularly the basic separation of each of the platens to each of the appropriate wafer holders, and approximate parallelism of the platens to the wafer holders. Also, the cam 22 must be realigned with the cam drive mechanism 20.

A piston-like structure included within each of the two stack frame end plates, which hold the platen stack, is illustrated in FIG. 13. The end of the platen stack vertical supports 9 are attached to the horizontal rods 24, which are in turn joined together, as shown, in the center of the stack. The stack frame end plate includes a constraining slot 27 which constrains a structure consisting of a support guide 25. The support guide 25 slides on the center section of the piston-like structure 26. The rods 24 also slide on the support guide 25 in a motion perpendicular to the motion along the center of the piston-like structure 26. To increase the smoothness of the motion of the various parts, the piston-like structure 26 may slide within some range along the slot 27. The net effect of these motion controls is to allow the platen stack to orbit, but to prevent the platen stack from rotating in its own frame of reference. This is required because the cam opening, which makes contact to the vertical supports of the platen stack, does not constrain the platen stack from orbiting in its own frame of reference as the cam drives the stack. Using the piston-like structure 26 within the slot 27, the stack will move in a circular orbit or in successive linear oscillations along the radii of the three rods 24 as the rod and piston pieces follow these motions.

The stack frame end plates are constructed so that a detachable section of each end plate contains the piston-like structure 26 coupled to the stack vertical support members 9. Then when routine servicing or repair is required, the detachable sections of the end plates are unlocked from the stack frame and the platen stack is lifted out of the stack frame with the detachable sections of the end plates, as one integral subassembly. In order to reassemble the platen stack and the stack frame, the subassembly is slid into the stack frame, through the cam, keyed into the stack frame and aligned with the stack frame. The wafer holders are then attached to the stack frame and finally the detachable sections of the stack frame end plates are locked back in place.

The size of the stack frame may vary depending on the size of the wafers to be polished. For polishing eight inch diameter silicon wafers, the size of the platens should be at least twelve inches in diameter. The stack frame with stack drive mechanisms and wafer holders will then be at least twenty inches in diameter. The platens of the preferred embodiment are approximately two inches thick, with slurry delivery channels built in. The separation between platens, in order to accommodate the insertion of the wafer holders, is approximately four inches. Thus, the total platen pitch of the preferred embodiment is on the order of six inches. The stack shown in FIG. 3, as an example, would have four platens 7 each with top and bottom polishing pads 8 and top and bottom platens 7 with one polishing pad 8 only. Eight wafers are then polished simultaneously on the four platens 7 with double pads. Wafers may also be polished on the top and bottom platens. The wafers polished on the top and bottom platens could be production wafers, monitor wafers or "dummy" wafers. In all these cases, the vertical forces applied to the platens throughout the stack are made to cancel out. Five identical wafer holders are inserted into the spaces between the platens 7. The stack height is then six platen pitches, or thirty six inches, plus the height of the stack frame end plates 10, which is six inches. Thus, the stack frame of the preferred embodiment, for polishing eight inch diameter wafers, has a diameter of approximately 20 inches and a height of approximately 42 inches. Within this stack at least eight wafers may be polished simultaneously.

For twelve inch diameter semiconductor wafers, a similar stack frame to the above would have a diameter of approximately 25 inches. The height of a stack frame for polishing twelve inch diameter wafers would be the same, 42 inches, as for the stack frame for polishing eight inch diameter wafers. Thus, within one overall polishing machine design, according to the present invention, stacks for either 8 inch wafer polishing or 12 inch wafer polishing may be accommodated.

Different wafer holder diameters are required for holding wafers of different diameters. However, a polishing machine according to the present invention, designed to polish twelve inch wafers, may be reconfigured to polish eight inch wafers utilizing the vertical stack for twelve inch wafers. Machine design changes are minimized. The wafer cassettes which store the wafers are of a different size, and the wafer transport holders which ride the elevators and which interface to the wafer cassettes need to have the capability to accommodate the smaller wafer diameter of the eight inch wafers. No other significant changes are needed to modify the stack, designed for use with twelve inch wafers, to be used with eight inch wafers.

Figure 14:
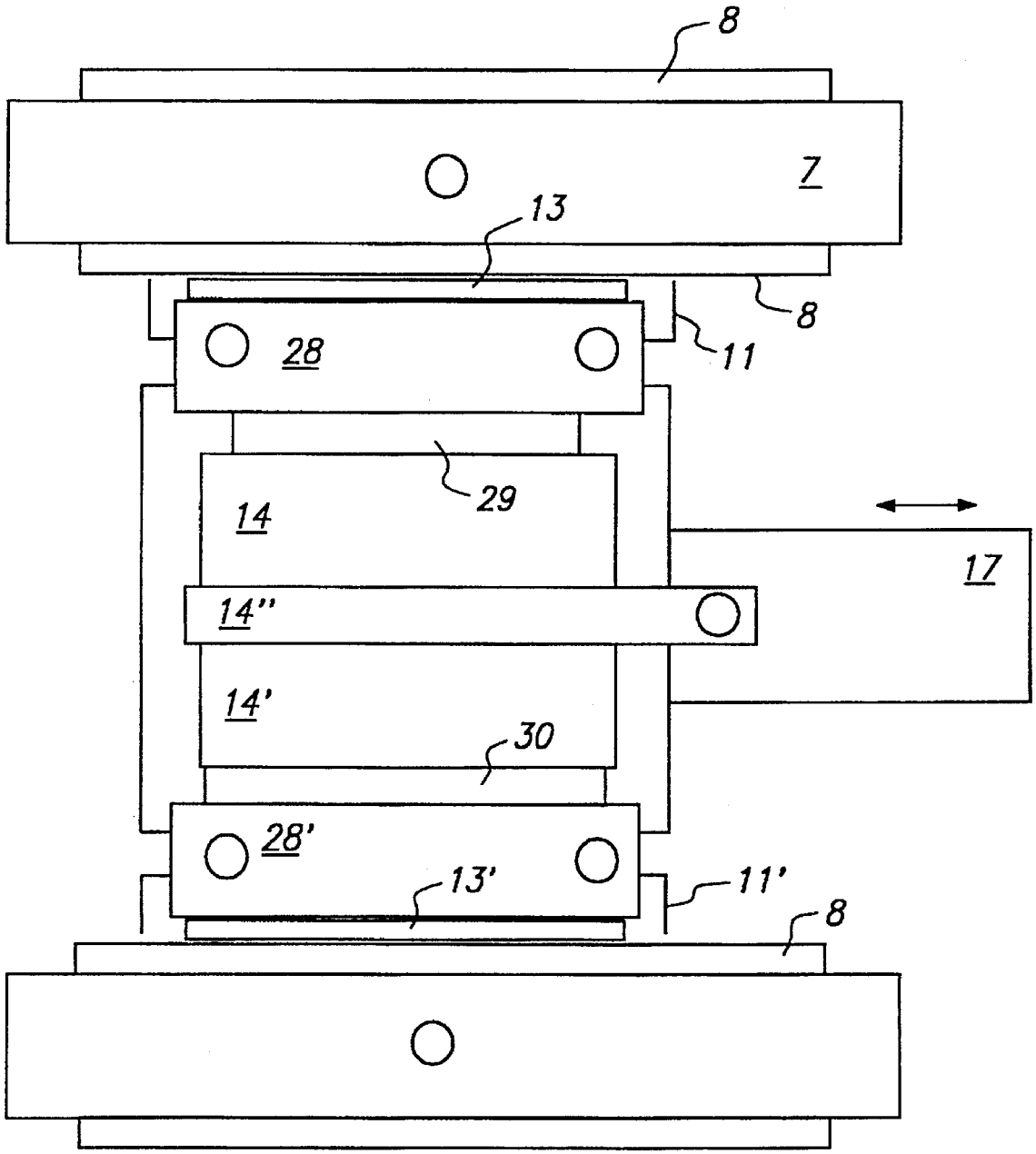
FIG. 14 illustrates a dual wafer holder, according to the present invention, for exerting pressure on wafers in both the downward and upward directions.

Additional features of the dual wafer holder of the present invention are illustrated in FIG. 14. The entire wafer holder is inserted and removed from the space between two successive platens as an integral unit by the transport means 17. Each of the two successive platens include polishing pads on both flat platen surfaces. Pressure is applied through a center section 14" of the wafer holder, so that the sections 14 and 14' are pushed in opposite directions from each other using hydraulic or pneumatic pressure. With pressure equalized across the surfaces of the sections 14 and 14', the two pieces 29 and 30, unequal in area, are used to transmit the pressure further in the direction of the two wafers 13 and 13'. The ratio of the areas of the two pieces are chosen so that the difference of the upward force from the downward force is equal to the weight of the wafer holder, including the wafer rotating subassemblies 28 and 28'. This pressure also exerts an amount of force on the lower wafer 13'.

The wafer rotating subassemblies 28 and 28' are implemented using either stepper motors or hydraulic vane pumps, which can transmit a continuous or stepped rotation to the wafers by applying torque to discs which then transmit the rotation to the wafers. Friction or an applied vacuum is utilized in a known manner to ensure that the wafers follow the rotation of the discs. With slurry injected between the pad surface and the wafer surface to be polished, a wafer is simultaneously subjected to vertical pressure and rotational torque.

Figure 15A:
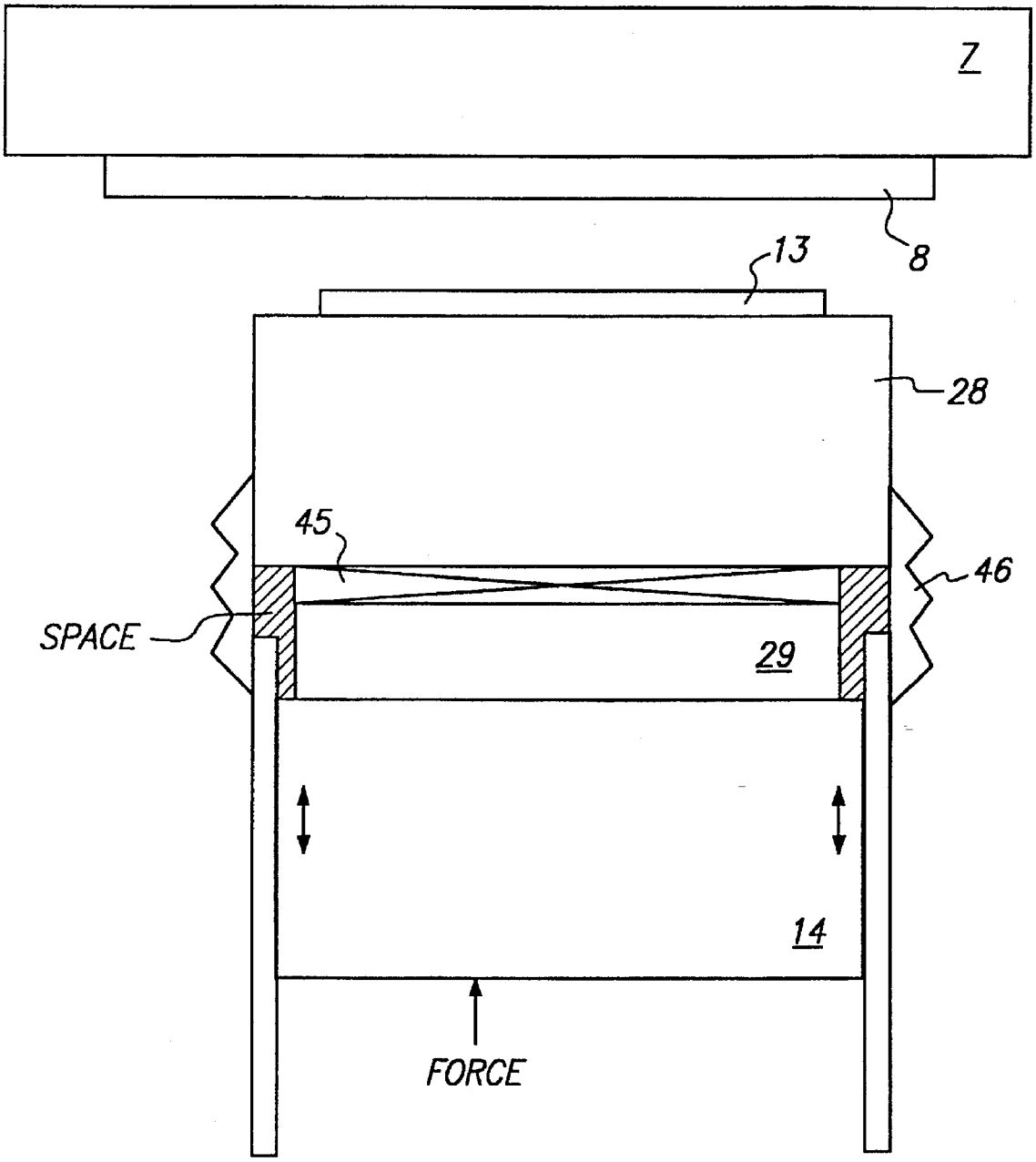
FIGS. 15A, 15B and 15C illustrate deforming interface materials used to self-align the wafer to the polishing pad.

The use of deforming interface materials to ensure self-alignment of the wafer 13 to the polishing pad 8 is illustrated in FIG. 15A. Self-alignment of the wafer 13 to the polishing pad 8 is accomplished using interface materials which will deform when pressure is applied. In the preferred embodiment of the present invention, a compressible sheet 45 is positioned between the pressure applying plate 29 and the wafer rotating subassembly 28. This compressible sheet 45 will compensate for any lack of parallelism between the wafer holder structure and the platen and the attached polishing pad. A flexible ring 46 couples the non-moving circumferential portion of the pressure applying subassembly 14 to the wafer rotating subassembly 28. The flexible ring 46 will distort with a portion of the ring in compression and a portion of the ring in tension as the wafer 13 is pressed against the pad and is held parallel to the pad by the compression of the compressible sheet 45.

Figure 15B:
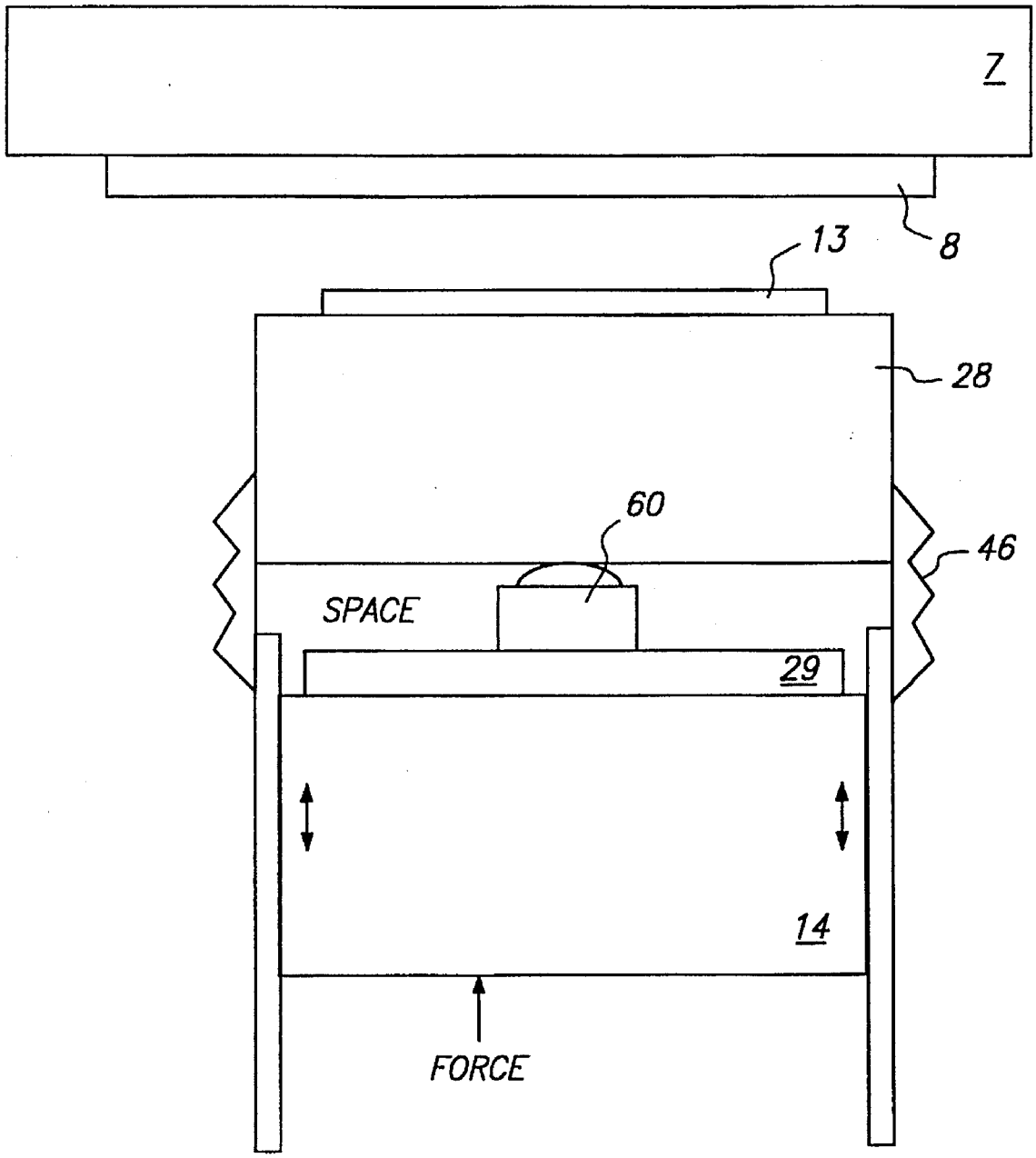

An alternative alignment scheme embodiment is illustrated in FIG. 15B. In this embodiment a gimble subassembly allowing all angles of motion is positioned between the pressure applying plate 29 and the wafer rotating subassembly 28. The wafer rotating subassembly 28 is coupled to the gimbal subassembly 60 and is made parallel to the platen as the pressure pushes the wafer 13 against the polishing pad 8.

Figure 15C:
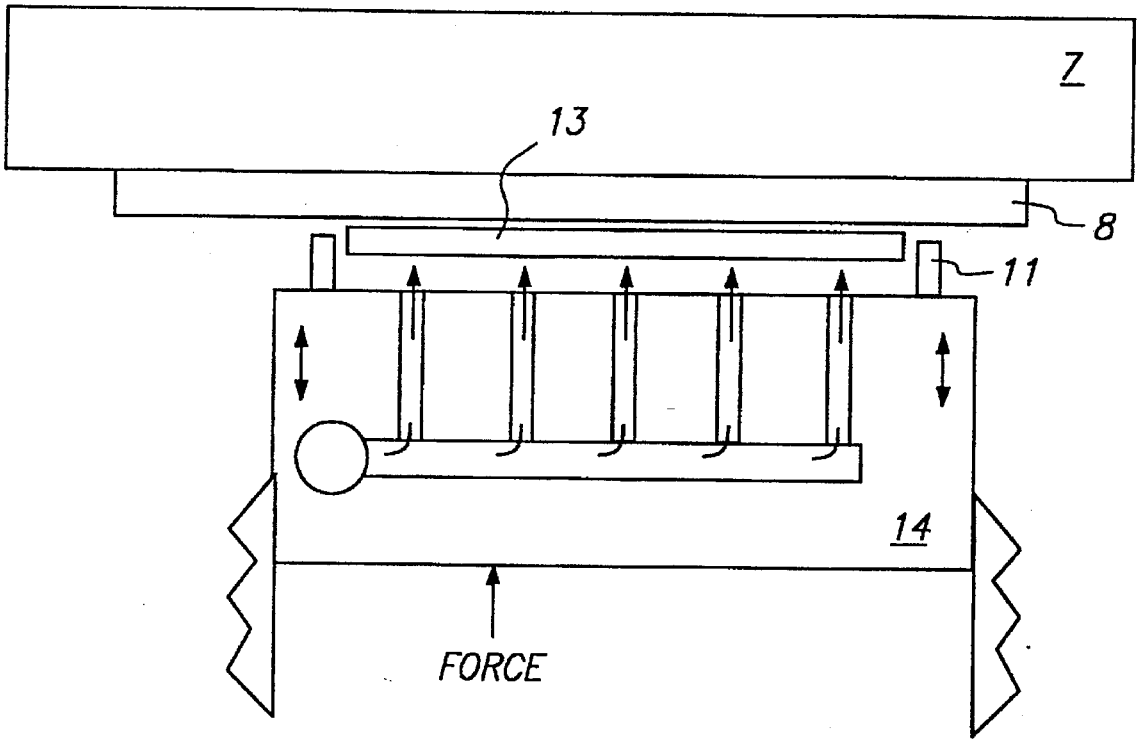

A further alternative self-alignment scheme is illustrated in FIG. 15C. The wafer 13 is pressed against the polishing pad 8 by backside air pressure supplied through the wafer holder assembly 14. In this scheme there is no subassembly to cause controlled wafer rotation. The wafers are constrained by an outside ring 11. The wafer 13 is free to move through an orbital path if there is sufficient drag applied to the wafer surface 13 due to the orbiting motion of the platen 7. The drag is transmitted through the slurry occupying the interface between the polishing pad 8 and the wafer 13. In this embodiment, the slurry is supplied through the polishing pad 9. The slurry will then exit through or around the outside ring 11. When wafers are to be inserted or removed from the platen stack of this alternate embodiment, a vacuum can be applied to the wafers instead of the backside air pressure.

Slurry flow is impeded by the barrier pieces 11 and 11' as illustrated in FIG. 14. Sufficient slurry is always available before and during application of the vertical pressure to the wafers. In the wafer holder, as illustrated in FIG. 14, the slurry is fed through the pad, as previously referenced. The circles in the various components of the wafer holder represent locations where fluid flow may be required as part of the operation of polishing wafers. Slurry will cascade down the stack to a catch basin. The catch basin is part of the bottom of the stack frame, or part of the machine structure underneath the stack frame. The slurry captured by the catch basin is either discarded, or treated and recycled, so it mixes with incoming fresh slurry. It is then delivered to the interface between the polishing pad 8 and the wafer 13 where polishing takes place. Catch basins are well known in the art.

When polishing of wafers is completed, the vertical pressure applied to keep the wafer 13 in contact with the polishing pad 8 will be removed. Wafer rotation, if any, and slurry flow will both be stopped. A backside vacuum may be applied to the wafer to keep it coupled to the wafer holder. The wafer holder will be removed from the space between the platens to a space where wafer transports moved by vertical elevators can remove the wafers from the wafer holders. In the process of moving the wafer holders and removing the wafers from the holders by the wafer transports, application of air pressure, vacuum and/or mechanical motion in some combination is required. Once the polished wafer is removed from the wafer holder, a new wafer is inserted into the wafer holder to be polished.

Figure 16:
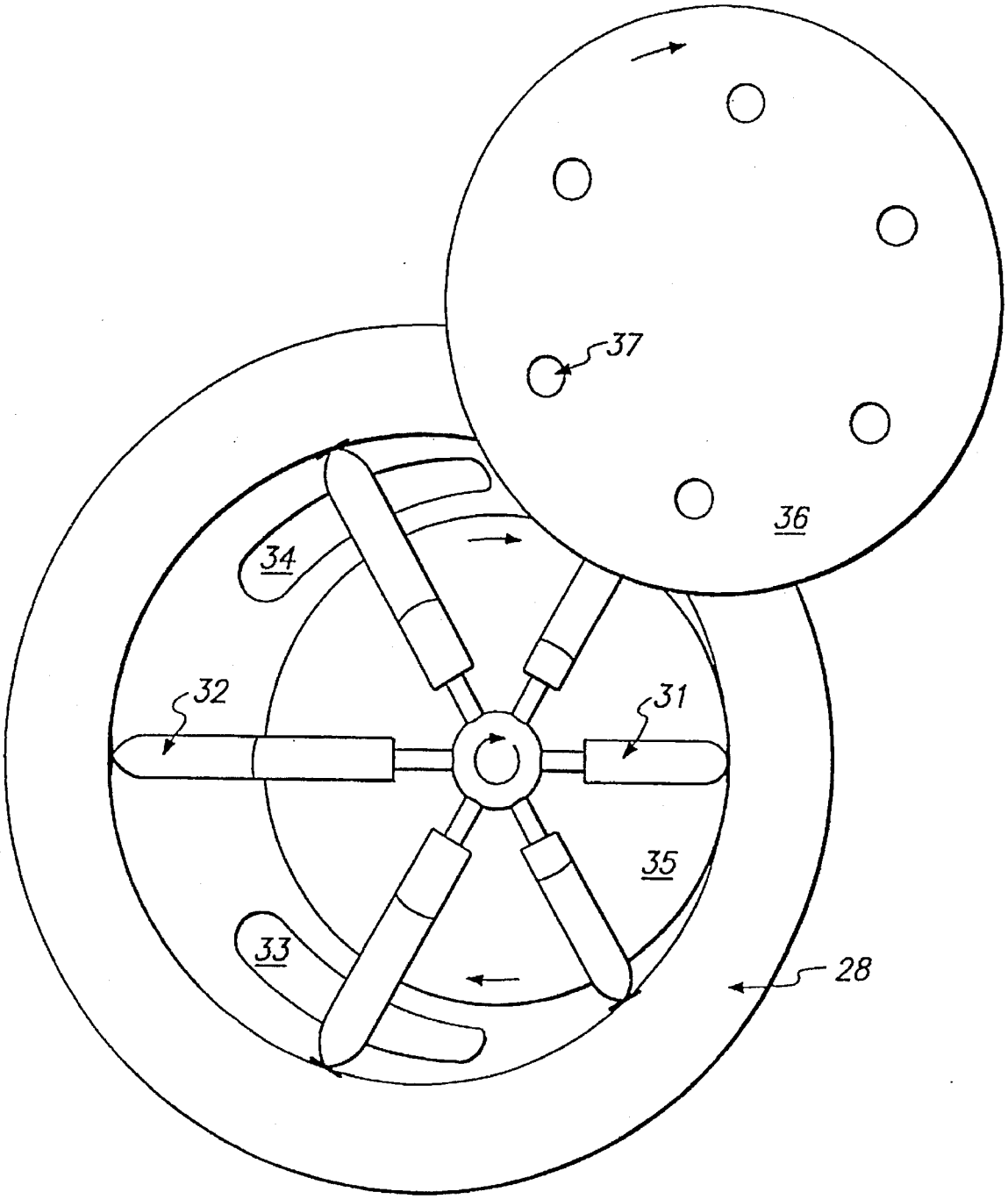
FIG. 16 illustrates a schematic of a vane pump of the present invention.

A schematic of a vane pump 28 is illustrated in FIG. 16. The vane pump 28 uses hydraulic pressure with fluid flow between an inlet 33 and an outlet 34 to cause the rotation of a subassembly. The subassembly includes a disc 35, offset from the center of the vane pump 28, and spring loaded arms 31 and 32 which always make contact with the fluid carrying chamber as the subassembly rotates. A disc 36, which holds the wafer, must attach to a rotor 31 of the vane pump. The fluid flow is continuous, or stepped in time, resulting in continuous or stepped rotation of the wafer. The circles 37 on the disc 36 represent a means for supplying air pressure or vacuum to the wafer as needed. For example, a backside vacuum may be applied to the wafer while it is step rotated, followed by backside pressure as polishing is continued.

Figure 17:
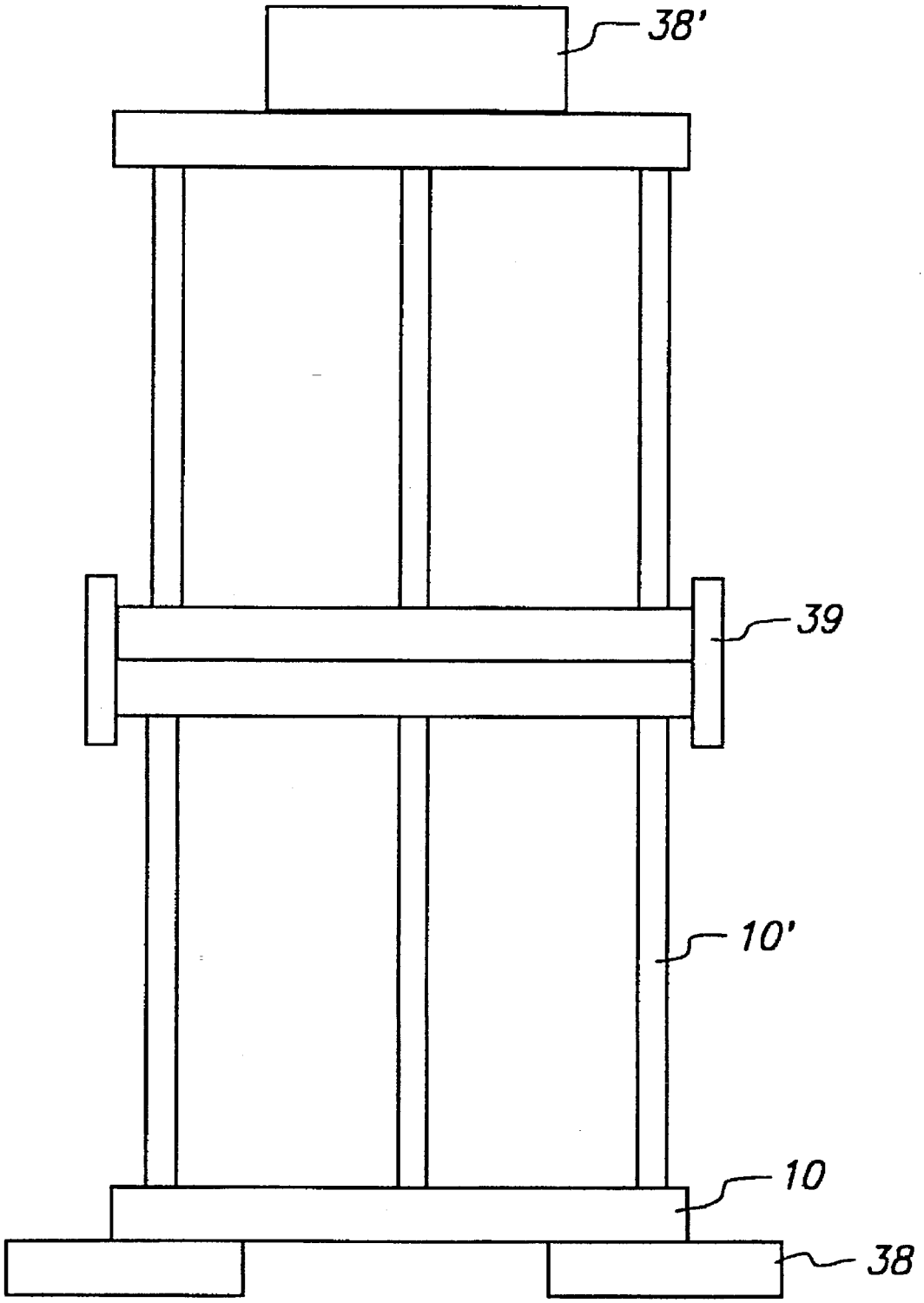
FIG. 17 illustrates two vertical stack frames stacked one on top of the other.

The vertical stack frames of the present invention are designed to be integrally stacked or otherwise integrated together allowing multiple vertical stack frames to be included within a single polishing machine. FIG. 17 illustrates how two or more stack frames, each containing its own platen stack and stack drive, are assembled, one on top of the other into a super assembly. The two stack frames are joined together at the joint 39. This super assembly is then locked into the structure of the polishing machine 38 and 38'. The structure of the polishing machine is designed to allow insertion and removal of the stack frames from the machine for servicing. When multiple stack frames are coupled together into a super-assembly, some of the platen stacks are orbited clockwise and others are orbited counterclockwise to reduce the forces and torques on various parts of the machine structure which would be present if all of the platen stacks were orbited in the same direction.

Figure 18:
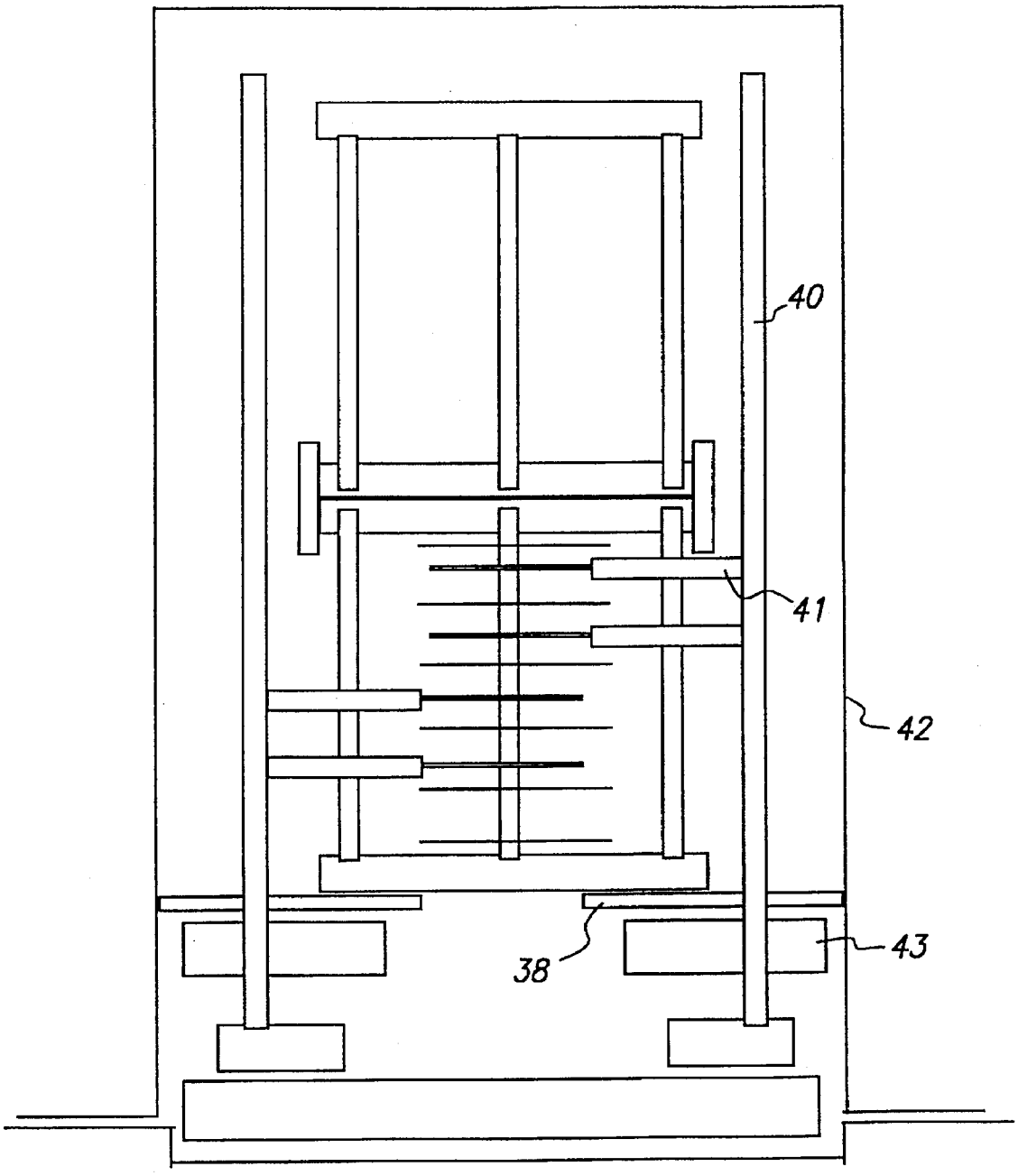
FIG. 18 illustrates a polishing machine including two vertically stacked flames stacked one on top of the other.

A polishing machine including two vertical stack frames is illustrated in FIG. 18. Two vertical stack frames are coupled together into a super-assembly, one vertical stack frame mounted on top of the other. It should be apparent to those skilled in the art that the number of stack frames mounted on top of each other in a super-assembly may be more than two. Each vertical stack may include two or more platens, with either one surface or both surfaces of each platen used for polishing. The number of stack frames and the number of platens per stack will be determined by practical design considerations and the amount of space available for the polishing machine within the manufacturing facility.

The vertical stack illustrated in FIG. 3, will polish 8–10 wafers simultaneously. The stack frame dimensions for the vertical stack illustrated in FIG. 3 were estimated to be 20–25 inches in diameter by 42 inches high. Vertically stacking two stack frames having those dimensions in a polishing machine is conceivable with the floor to ceiling heights allowed in a typical wafer production clean room. Having four stack frames, each having the capability to polish four wafers simultaneously, vertically stacked within a polishing machine is an alternative configuration. In these stacked vertical stacks 16–20 wafers can be simultaneously polished. It should be recognized that simultaneously polishing 20 wafers in such a stack will require use of the end platens.

In FIG. 18, the elevators 40 are mounted on the polishing machine structure and include wafer and pad conditioner transport holders 41 which are used to move wafers and pad conditioners up and down the stacks. An elevator may transport more than one wafer simultaneously. An enclosing housing 42 of the polishing machine contains the stack frames and the elevators. The housing 42 must be removed to gain access to moving parts and to disassemble the internal subsystems within the polishing machine. Wafers are passed into and out of the housing 42 by the movement and actuation of the transport holders through the openings 43. The wafer holders on the stack frame will swing in and out of the spaces between the platens to allow access to the wafer transport holders 41 on the elevators 42 for bringing wafers to the wafer holders for polishing and transporting polished wafers away from the wafer holders. The pad conditioner transport holders include the mechanisms for actuating the required movements of the pad conditioners to make contact with the polishing pads and to move the pad conditioners over the surface of the pads to perform a conditioning operation. In the preferred embodiment, one elevator is used for wafer input to the stack and a separate elevator is used for wafer output from the stack, rather than using an elevator for both input and output. This has an inherent advantage in terms of the cycle time of wafer transport to and from wafer cassettes. However, it should be apparent to those skilled in the art that a single elevator may be used for both wafer input to and wafer output from the stack.

Figure 19:
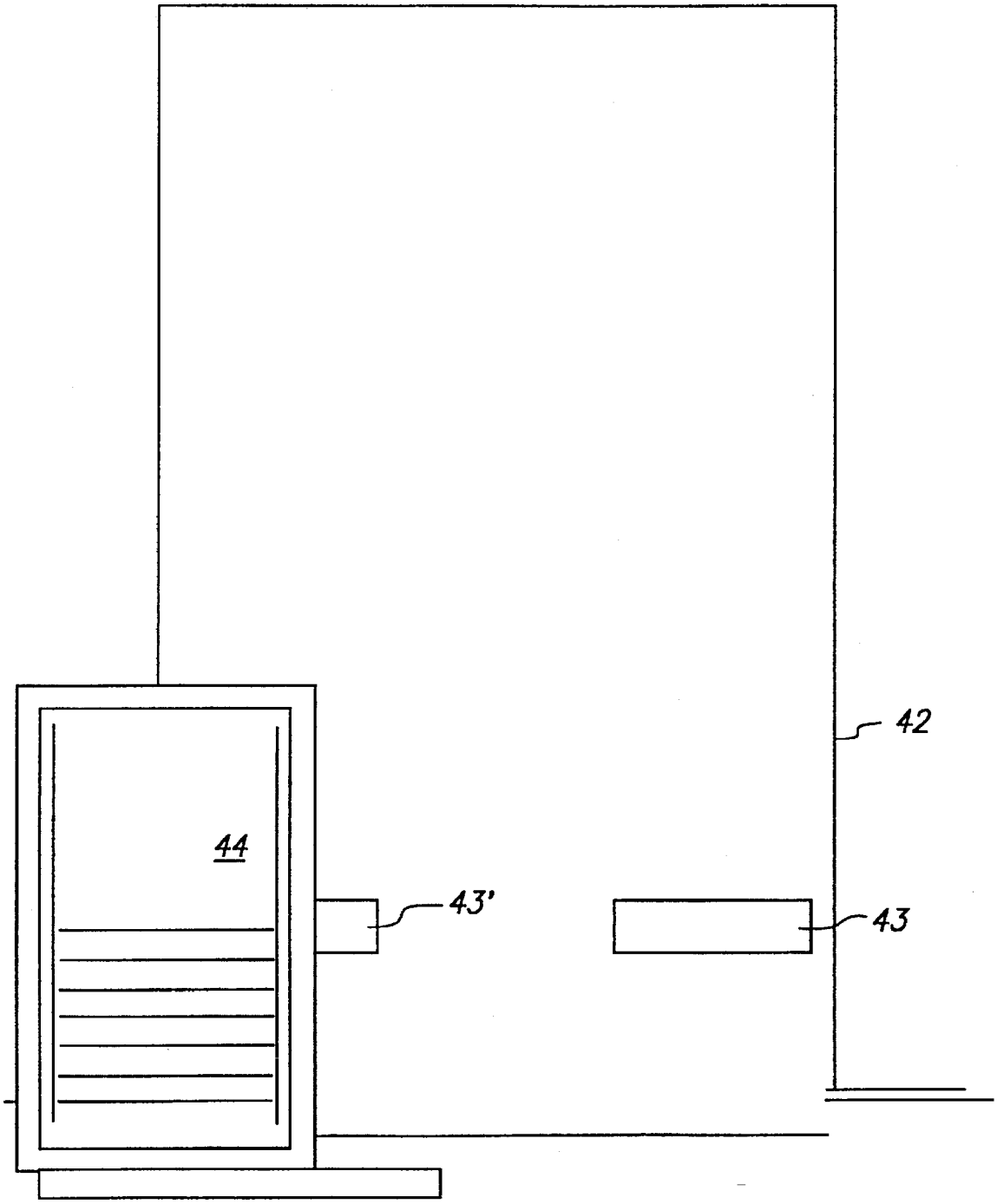
FIG. 19 illustrates the outside of the enclosing housing which encloses the polishing machine, including openings through which wafers are passed.

The outside of the enclosing housing 42 is illustrated in FIG. 19. The wafers are passed through the openings 43 and 43' to and from a wafer cassette or monitoring station 44.

Figure 20:
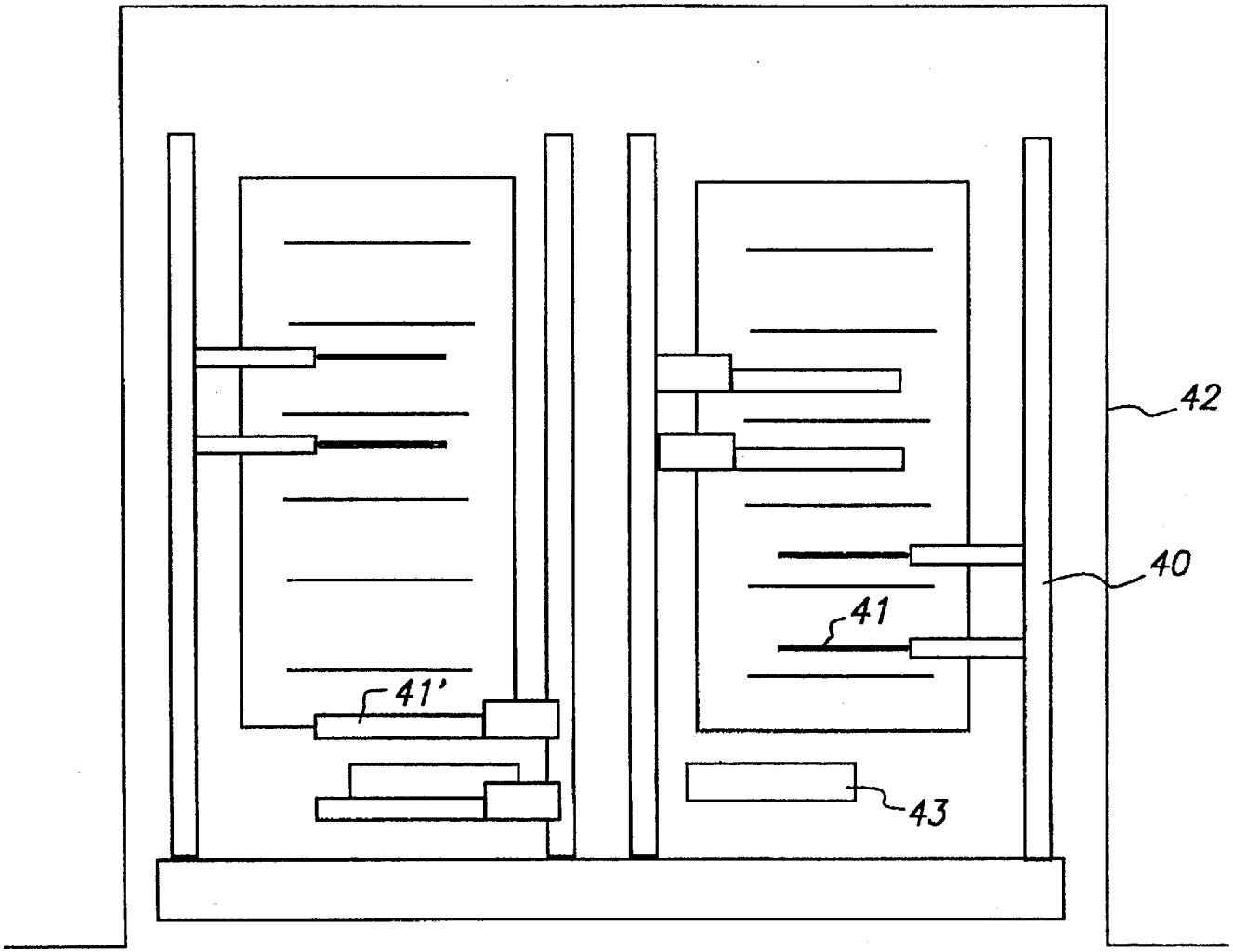
FIG. 20 illustrates two side by side vertical stacks within a single polishing machine.

Two side by side vertical stacks within a single polishing machine are illustrated in FIG. 20. In this embodiment, each stack has its own dedicated elevators 40. Alternatively, elevators may be shared between neighboring stacks. For example, with two side by side vertical stacks a single elevator may be positioned between the stacks to service both stacks.

A polishing machine according to the present invention, using the platen stack examples described earlier, could simultaneously polish 32–40 wafers. This is a dramatic increase over currently known xy polishing machines, which only have the capability to simultaneously polish from 1–6 wafers. The floor space taken up by the vertically stacked machine according to the present invention, having the capacity to simultaneously polish 32–40 wafers, is not significantly different than the floor space taken up by the horizontal polishing machines of the prior art which can only polish 1–6 wafers.

The polishing machine electronics cabinets and control computers have not been shown or described in detail. However, the electronics cabinets and control computers required for the operation of a polishing machine according to the present invention, are readily adaptable from components used with polishing machines of the prior art, as will be apparent to those skilled in the art.

Also not shown or described in detail are wafer cleaners and scrubbers which are commonly employed in wafer polishing operations. The cleaners and scrubbers may be integrated into the polishing machine, or kept separate from it. People or robots are used to transport wafer cassettes between polishers, cleaners, scrubbers and cassette storage bins. Currently known configurations have one to three polishing machines connected to a scrubber in actual production operations because the scrubber can often process more wafers per hour than a single polishing machine. A stacked polishing machine according to the present invention, simultaneously processing 8–32 wafers may require more than one cleaner/scrubber per polishing machine. In this case the transport of wafer cassettes will be different, but not inherently more complex, than the case where one cleaner/scrubber services several polishers.

In a stacked polishing machine according to the present invention including two or more individual stack frames within one machine, it is possible to have the machine be operable with fewer than the maximum number of individual stack frames actually polishing wafers. Such a system allows three options for the machine. The first option is to configure the machine in a minimum configuration with one stack frame included. If desired, additional stack frames may be added until the polishing machine includes a full capacity of stack frames. The second option is to include multiple stack frames within the polishing machine and operate the machine with only some of the stacks simultaneously polishing, rather than all of them. This option may be useful when not enough wafer inventory is available to polish a full load, or when one or more stack frames suffer a failure. In the failure mode, the machine will still have the ability to operate but at a reduced output rate, until a time when it is convenient to take the machine off line for repair. The third option is to disassemble the machine, followed by reassembling it with a fewer number of wafer stack frames put back into operation. This option would be useful if a wafer stack frame required extensive servicing for some reason, and a replacement stack was not available. The polisher could still be put back on line with a temporarily reduced output rate.

The platen stacks of the present invention are interchangeable among stack frames, allowing for more flexibility in the use of platen stacks within a set of polishing machines on a production floor. Because of this, extra platen stacks may be inventoried as spares to be used to replace stacks which are being serviced. This configuration minimizes the down time for a given machine or a given stack frame.

The vertical stack frame of the present invention allows the capacity of a manufacturing facility to be increased because more wafers may be simultaneously polished within the same mount of floor space as required for an xy polishing machine of the prior art.

It will be readily apparent to one reasonably skilled in the art that other various modifications may be made to the preferred embodiment without departing from the spirit and scope of the invention as defined by the appended claims.

I claim:

1. A method of constructing and operating a vertically stacked planarization machine for polishing wafers including the steps of:

a. coupling together a plurality of vertically stacked platens, thereby forming a platen stack, each vertically stacked platen including a polishing surface;

b. orbiting the platen stack; and c. holding a wafer in contact with the polishing surface of one of the vertically stacked platens.

2. The method as claimed in claim 1 further comprising the step of transporting the wafer to be held in contact with the polishing surface.

3. The method as claimed in claim 2 further comprising the step of conditioning the polishing surface of the vertically stacked platen.

4. The method as claimed in claim 2 wherein the step of orbiting is performed using a cam having a motor for driving the platen stack.

5. The method as claimed in claim 1 wherein the step of holding is performed using a wafer holder for holding the wafer in contact with the polishing surface of one of the vertically stacked platens.

6. The method as claimed in claim 5 wherein at least one of the vertically stacked platens includes a top polishing surface and a bottom polishing surface.

7. The method as claimed in claim 6 wherein the wafer holder is a dual wafer holder for holding a top wafer against a top polishing surface of a first platen and a bottom wafer against a bottom polishing surface of a second platen.

8. The method as claimed in claim 7 wherein the dual wafer holder exerts equal pressure on the top wafer and the bottom wafer.

9. The method as claimed in claim 5 wherein the step of holding is accomplished using hydraulic means for holding the wafer in contact with the polishing surface.

10. The method as claimed in claim 5 wherein the step of holding is accomplished using pneumatic means for holding the wafer in contact with the polishing surface.

11. The method as claimed in claim 5 further comprising the step of rotating the wafer.

12. A method of constructing a planarization machine for polishing wafers including the steps of:

a. coupling together a plurality of vertically stacked platens thereby forming a platen stack, each platen including a polishing surface; and b. providing transport means for transporting wafers to and from the platen stack for polishing.

13. The method as claimed in claim 12 further comprising the step of including a cam having a motor for driving the platen stack.

14. The method as claimed in claim 13 wherein the platen stack is driven in an orbital fashion.

15. The method as claimed in claim 14 further comprising the step of providing holding means for holding a wafer in contact with the polishing surface of one of the vertically stacked platens.

16. A method of operating a vertically stacked planarization machine for polishing wafers, wherein the vertically stacked planarization machine includes a plurality of vertically stacked platens each including a polishing surface, comprising the steps of:

a. orbiting the plurality of vertically stacked platens; and b. holding a wafer in contact with the polishing surface of one of the vertically stacked platens.

17. The method as claimed in claim 16 wherein the step of holding is performed using a wafer holder for holding the wafer in contact with the polishing surface of one of the vertically stacked platens.

18. The method as claimed in claim 17 further comprising the step of transporting the wafer to the wafer holder for holding in contact with the polishing surface.

19. The method as claimed in claim 18 wherein at least one of the vertically stacked platens includes a top polishing surface and a bottom polishing surface.

20. The method as claimed in claim 19 wherein the wafer holder is a dual wafer holder for holding a top wafer against a top polishing surface of a first platen and a bottom wafer against a bottom polishing surface of a second platen.

21. The method as claimed in claim 20 wherein the dual wafer holder exerts equal pressure on the top wafer and the bottom wafer.

22. The method as claimed in claim 17 wherein the step of holding is accomplished using hydraulic means for holding the wafer in contact with the polishing surface.

23. The method as claimed in claim 17 wherein the step of holding is accomplished using pneumatic means for holding the wafer in contact with the polishing surface.

24. The method as claimed in claim 17 further comprising the step of rotating the wafer.

25. The method as claimed in claim 16 further comprising the step of conditioning the polishing surface of the vertically stacked platen.

26. The method as claimed in claim 16 wherein the step of orbiting is performed using a cam having a motor for driving the platen stack.

* * * * *

UNITED STATES PATENT AND TRADEMARK OFFICE

CERTIFICATE OF CORRECTION

PATENT NO. : 5,655,949

DATED : 8/12/97

INVENTOR(S) : Richmond B. Clover

It is certified that error appears in the above-identified patent and that said Letters Patent is hereby correct as shown below:

On the title page, item [54] amd column 1:

IN THE TITLE

Delete "WAXERS" and insert --WAFERS--.

IN THE REFERENCES CITED

Delete "Bpouladon et al." and insert --Bouladon et al.--.

The following patent was not included in the printed patent references cited:
Insert --5,234,867, 8/1993, Schultz et al., 437/225--.

In column 8, line 43 and 44, delete "subassembly allowing" and insert --subassembly 60 allowing--.

In column 11, line 62, delete "same mount of" and insert --same amount--.

Signed and Sealed this

Fourth Day of November, 1997

*Attest:*

BRUCE LEHMAN

*Attesting Officer*

*Commissioner of Patents and Trademarks*